US009076440B2

(12) United States Patent
Shirakawa et al.

(10) Patent No.: US 9,076,440 B2
(45) Date of Patent: Jul. 7, 2015

(54) AUDIO SIGNAL ENCODING DEVICE, METHOD, AND MEDIUM BY CORRECTING ALLOWABLE ERROR POWERS FOR A TONAL FREQUENCY SPECTRUM

(75) Inventors: Miyuki Shirakawa, Fukuoka (JP); Masanao Suzuki, Kawasaki (JP); Yoshiteru Tsuchinaga, Fukuoka (JP)

(73) Assignee: FUJITSU LIMITED, Kawasaki (JP)

( * ) Notice: Subject to any disclaimer, the term of this patent is extended or adjusted under 35 U.S.C. 154(b) by 1785 days.

(21) Appl. No.: 12/367,963

(22) Filed: Feb. 9, 2009

(65) Prior Publication Data

US 2009/0210235 A1 Aug. 20, 2009

(30) Foreign Application Priority Data

Feb. 19, 2008 (JP) ..... 2008-037991

(51) Int. Cl.

| | |
|---|---|
| ***G10L 25/00*** | (2013.01) |
| ***G10L 19/00*** | (2013.01) |
| ***G10L 21/00*** | (2013.01) |
| ***G10L 19/035*** | (2013.01) |
| *G10L 19/02* | (2013.01) |

(52) U.S. Cl.

CPC ..... *G10L 19/035* (2013.01); *G10L 19/0212* (2013.01)

(58) Field of Classification Search

CPC ..... G10L 19/00; G10L 19/02; G10L 19/0204; G10L 19/0208; G10L 19/032

USPC ..... 704/200, 229, 230, 205, 500

See application file for complete search history.

(56) References Cited

U.S. PATENT DOCUMENTS

| | | | | |
|---|---|---|---|---|
| 4,972,484 | A | 11/1990 | Theile et al. | |
| 5,590,108 | A | 12/1996 | Mitsuno et al. | |
| 5,684,922 | A | 11/1997 | Miyakawa et al. | |
| 5,918,203 | A * | 6/1999 | Herre et al. | 704/205 |
| 6,029,134 | A | 2/2000 | Nishiguchi et al. | |
| 6,138,101 | A * | 10/2000 | Fujii | 704/500 |
| 6,199,038 | B1 * | 3/2001 | Tsutsui | 704/229 |

(Continued)

FOREIGN PATENT DOCUMENTS

| | | |
|---|---|---|
| JP | 1-501435 | 5/1989 |
| JP | 6-318875 | 11/1994 |

(Continued)

OTHER PUBLICATIONS

Office Action mailed Dec. 7, 2011 in related U.S. Appl. No. 12/654,591.

(Continued)

*Primary Examiner* — Paras D Shah

(74) *Attorney, Agent, or Firm* — Staas & Halsey LLP

(57) ABSTRACT

A disclosed encoding device converts an audio signal into frequency spectra, determines allowable error powers with respect to bands divided by the frequency of the audio signal by a predetermined with, detects a tonal frequency spectrum from the frequency spectra, and detects a band containing the frequency spectrum. Using the detection result and the allowable error powers, the encoding device performs correction such that allowable error powers determined by a power determining unit with respect to bands adjacent to the band detected by a detecting unit become smaller than the powers of the frequency spectra with respect to the adjacent bands, and quantizes each of frequency spectra having greater powers than the corrected allowable error powers.

10 Claims, 23 Drawing Sheets

(56) References Cited

U.S. PATENT DOCUMENTS

| | | | | |
|---|---|---|---|---|
| 6,295,009 | B1 * | 9/2001 | Goto | 341/50 |
| 6,308,150 | B1 * | 10/2001 | Neo et al. | 704/200.1 |
| 6,370,499 | B1 * | 4/2002 | Fujii | 704/200.1 |
| 6,385,572 | B2 * | 5/2002 | Hu | 704/200.1 |
| 6,456,968 | B1 * | 9/2002 | Taniguchi et al. | 704/229 |
| 6,629,283 | B1 * | 9/2003 | Toyama | 714/746 |
| 6,725,192 | B1 * | 4/2004 | Araki | 704/230 |
| 6,745,162 | B1 * | 6/2004 | Hu | 704/200.1 |
| 6,778,953 | B1 * | 8/2004 | Edler et al. | 704/200.1 |
| 6,801,886 | B1 * | 10/2004 | Pai et al. | 704/200.1 |
| 6,826,526 | B1 * | 11/2004 | Norimatsu et al. | 704/222 |
| 6,895,374 | B1 * | 5/2005 | Pai | 704/200.1 |
| 7,110,941 | B2 * | 9/2006 | Li | 704/200.1 |
| 7,333,930 | B2 * | 2/2008 | Baumgarte | 704/200.1 |
| 7,483,836 | B2 | 1/2009 | Taori et al. | |
| 7,516,074 | B2 | 4/2009 | Bilobrov | |
| 7,546,240 | B2 | 6/2009 | Mehrotra et al. | |
| 7,613,605 | B2 * | 11/2009 | Funakoshi | 704/219 |
| 7,627,469 | B2 * | 12/2009 | Nettre et al. | 704/220 |
| 7,627,481 | B1 * | 12/2009 | Kuo et al. | 704/500 |
| 7,630,170 | B2 * | 12/2009 | Hayakawa et al. | 360/99.21 |
| 7,634,400 | B2 * | 12/2009 | Averty et al. | 704/205 |
| 7,873,510 | B2 * | 1/2011 | Kurniawati et al. | 704/200.1 |
| 7,974,848 | B2 * | 7/2011 | Kim et al. | 704/500 |
| 2002/0120442 | A1 * | 8/2002 | Hotta | 704/229 |
| 2004/0098268 | A1 * | 5/2004 | Ha | 704/500 |
| 2004/0162720 | A1 * | 8/2004 | Jang et al. | 704/200.1 |
| 2005/0198061 | A1 | 9/2005 | Robinson et al. | |
| 2005/0259819 | A1 | 11/2005 | Oomen et al. | |
| 2005/0267744 | A1 | 12/2005 | Nettre et al. | |
| 2006/0004565 | A1 * | 1/2006 | Eguchi | 704/200.1 |
| 2007/0016405 | A1 | 1/2007 | Mehrotra et al. | |
| 2007/0055500 | A1 | 3/2007 | Bilobrov | |
| 2007/0162277 | A1 * | 7/2007 | Kurniawati et al. | 704/200.1 |
| 2008/0052068 | A1 * | 2/2008 | Aguilar et al. | 704/230 |
| 2008/0133223 | A1 * | 6/2008 | Son et al. | 704/200.1 |
| 2010/0153099 | A1 | 6/2010 | Goto et al. | |
| 2011/0270616 | A1 * | 11/2011 | Garudadri et al. | 704/500 |

FOREIGN PATENT DOCUMENTS

| | | |
|---|---|---|
| JP | 7-050589 | 2/1995 |
| JP | 7-170194 | 7/1995 |
| JP | 07-202823 | 8/1995 |
| JP | 07-295594 | 11/1995 |
| JP | 10-207849 | 8/1998 |
| JP | 2000-293199 | 10/2000 |
| JP | 2001-7704 | 1/2001 |
| JP | 2001-282288 | 10/2001 |
| JP | 2001-343998 | 12/2001 |
| JP | 2002-268693 | 9/2002 |
| JP | 2004-522198 | 7/2004 |
| JP | 2005-258158 | 9/2005 |
| JP | 2005-338637 | 12/2005 |
| JP | 2006-18023 | 1/2006 |
| JP | 2007-104598 | 4/2007 |
| WO | 88/04117 | 6/1988 |
| WO | 02/091363 | 11/2002 |
| WO | 2007/037359 | 4/2007 |

OTHER PUBLICATIONS

Notice of Allowance mailed May 10, 2012 in related U.S. Appl. No. 12/654,591.

U.S. Appl. No. 12/654,591, filed Dec. 23, 2009, Miyuki Shirakawa et al, Fujitsu Limited, Kawasaki, Japan.

International Search Report mailed on Oct. 16, 2007 in Application PCT-JP2007-063395.

Japanese Office Action mailed Jan. 25, 2013 in Japanese Patent Application 2009-521487.

* cited by examiner

Equation 1 : Inversely Quantized Spectrum

Sprctrum after Quantized = Quantization Value × 2^(Scale Factor)

Quantization Value = int(Frequency Spectrum before Quantization × 2 ^ ( (Scale Factor)) )

Equation 2 : Quantization (Scaling and Quantization)

Fig. 2

Fig. 7A
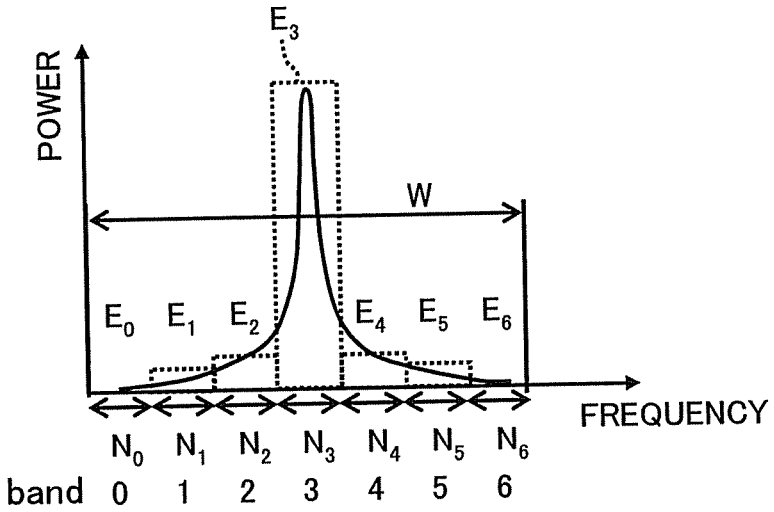
Fig. 7B
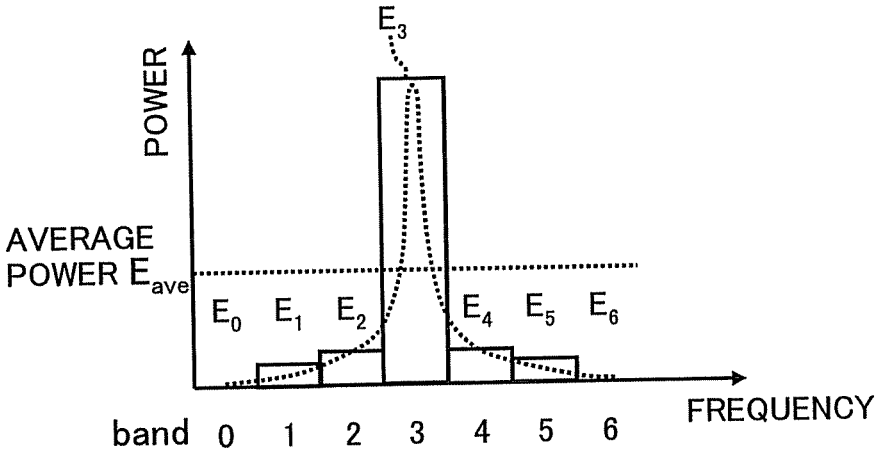
Fig. 7C $E_{ave}=\left(\sum_{band=0}^{6} E_{band}\right)\Big/7$
Fig. 7D
```
if(Eband>Eave){
  tone_band=band
  tone_flag=1
}else{
  tone_flag=0
}
```

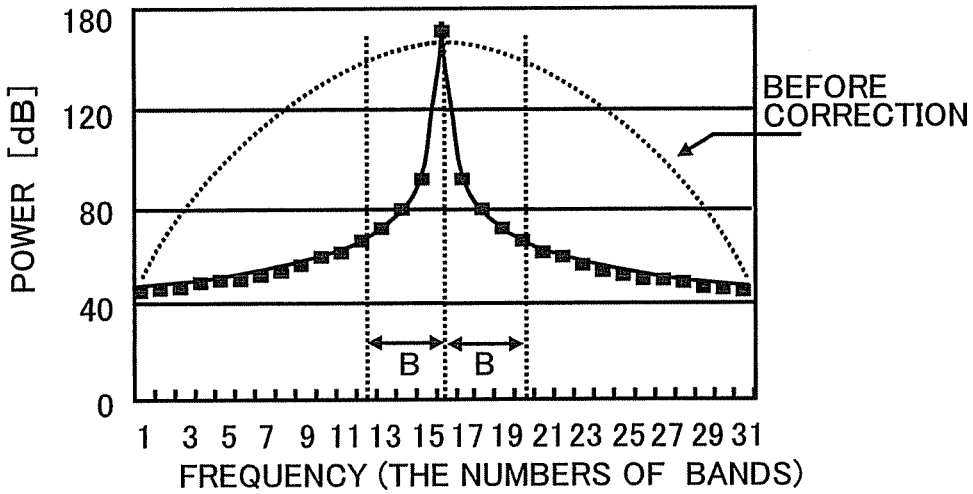
Fig. 10A
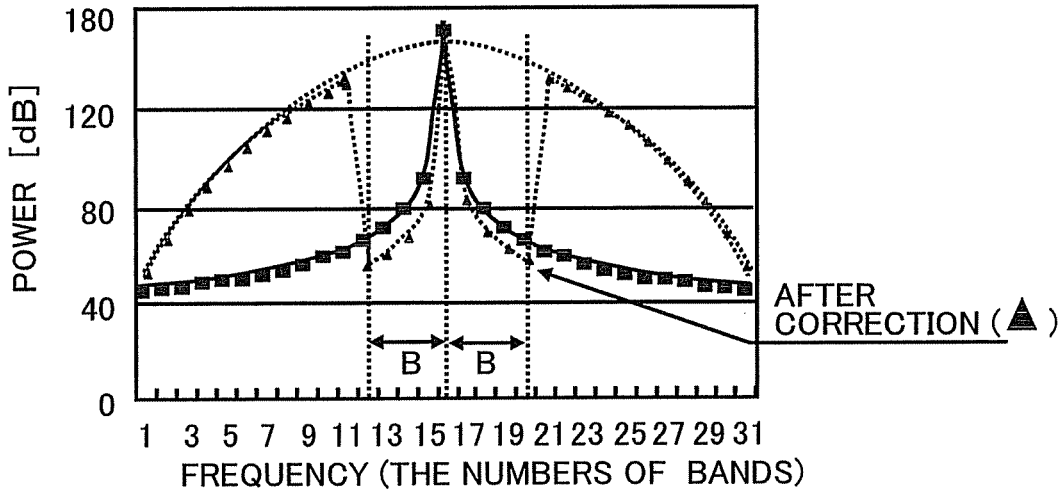
Fig. 10B
Fig. 10C $M'_{b-1} = g \cdot E_{b-1}$
Fig. 10D
```
if (E_band 〉E_ave){
  tone_band = band
  tone_flag = 1
}else{
    tone_flag = 0
```

$$S_b' = (\text{int})\left( C \times \log_2 \left( \frac{\text{max_pow_spec}^{\frac{3}{4}}}{\text{MAX_QUANT}} \right) \right)$$

C, MAX_QUANT: constants
max_pow_spec: The maxium spectrum in a band $$\text{quant}_i = (\text{int})\left[\text{spec}_i^{\frac{3}{4}} \cdot 2^{0.1875 \cdot S_b} + \text{MAGIC_NUMBER}\right]$$

MAGIC_NUMBER : CONSTANT 0.4054 as the constant is used in a method according to Advanced Audio Coding.

Fig. 18A $$\text{ispec}_i = \text{quant}_i^{\frac{4}{3}} \cdot 2^{-0.25 \cdot S_b}$$

Fig. 18B $$\text{error_e}_b = \sum_{i=1}^{N_b} (\text{spec}_i - \text{ispec}_i)^2$$

Fig. 18C

AUDIO SIGNAL ENCODING DEVICE, METHOD, AND MEDIUM BY CORRECTING ALLOWABLE ERROR POWERS FOR A TONAL FREQUENCY SPECTRUM

CROSS-REFERENCE TO RELATED APPLICATION

This application is based upon and claims the benefit of priority of the prior Japanese Patent Application No. 2008-037991, filed on Feb. 19, 2008, the entire contents of which are incorporated herein by reference.

BACKGROUND

1. Field of the Invention

The present invention relates to an encoding device, an encoding method, and a program product including an encoding method.

2. Description of the Related Art

Conventionally, various researches have been done for audio coding technology for compressing/decompressing audio signals as sound sources for voice, music, and so on. For example, various researches are directed to schemes for encoding audio signals through conversion into frequency domain.

For example, such audio coding technology will be found in Advanced Audio Coding (ACC) method, High Efficiency-Advanced Audio Coding (HE-AAC) method. The AAC and the HE-AAC methods are ones of the ISO/IEC MPEG-2/4 audio standards and are widely used in a digital broadcasting, such as the digital terrestrial, the BS digital, and the Communication Satellite, and one segment broadcastings in Japan.

In such audio coding technology, a conventional encoding device for implementing the audio coding technology converts an audio signal into frequency spectra by Modified Discrete Cosine Transform (MDCT) conversion, quantizes the frequency spectra, and then performs encoding.

The conventional encoding device quantizes the frequency spectra by utilizing auditory masking properties. Specifically, the conventional encoding device quantizes only sound that can be heard by human auditory perception. In the quantization, a masking threshold as a threshold is used to determine components of sound that cannot be acoustically heard, namely the threshold for whether sound can be heard or not.

For example, the conventional encoding device performs psychoacoustic analysis, which is a scheme for analyzing whether or sound is acoustically heard or not, with respect to an audio signal (a sound source to be encoded). Then masking thresholds are determined for each frequency. Thereafter, for each band having a predetermined frequency width, the conventional encoding device determines an error limit. The error limit is an allowable error power that is allowed during quantization, based on the determined masking threshold. Then, using the allowable error power, the conventional encoding device quantizes only frequency spectra as a sound source that is acoustically heard.

Japanese Laid-open Patent Publication No. 2006-18023, pages 5 to 11 and FIG. 1, discloses a scheme for adjusting a masking threshold, Japanese Laid-open Patent Publication No. 2001-7704, pages 5 to 9 and FIG. 1, discloses a scheme for improving efficiency during encoding for reducing the usage amount of bits used during encoding. In addition, Japanese Laid-open Patent Publication No. 7-202823, pages 3-5 and FIG. 1, and Japanese Laid-open Patent Publication No. 7-295594, pages 2 to 3 and FIG. 1 disclose schemes for specifying the amount of bit distribution.

Meanwhile, the above-described conventional technologies have a problem in that the sound quality deteriorates during encoding of a tonal high audio signal.

In more detail, since the conventional encoding device cannot reliably quantize frequency spectra adjacent to the peak during encoding of a tonal audio signal, and the device cannot satisfactorily perform encoding while maintaining a sufficient sound quality.

The Japanese Laid-open Patent Publications described above do not disclose a scheme for reliably quantizing frequency spectra adjacent to the peak and cannot sufficiently improve the sound quality during encoding of a tonal audio signal.

SUMMARY

It is an object of the present invention to provide an encoding device capable of operating in a satisfactory state.

According to one aspect of the invention, there is provided an present encoding device for converting an audio signal into frequency spectra and quantizing and encoding the frequency spectra includes a power correcting unit for correcting allowable error powers determined in accordance with the audio signal when a tonal frequency spectrum is detected from the frequency spectra, and a quantizing unit for quantizing each of the frequency spectra having greater powers than the allowable error powers corrected by the power correcting unit.

According to another aspect of the invention, there is provided an encoding device for encoding an audio signal including a frequency converting unit for converting the audio signal into frequency spectra, a power determining unit for determining allowable error powers in accordance with the audio signal, a detecting unit for detecting a tonal frequency spectrum from the frequency spectra converted by the frequency converting unit, a power correcting unit for correcting the allowable error powers by using a result of the detection performed by the detecting unit and the allowable error powers determined by the power determining unit, and a quantizing unit for quantizing each of the frequency spectra having greater powers than the allowable error powers corrected by the power correcting unit.

BRIEF DESCRIPTION OF THE DRAWINGS

FIG. 2 illustrates a diagram showing the underlying technology of an encoding device according to the first embodiment;

FIGS. 7A to 7D illustrate diagrams showing a tone detecting unit of the coding device according to the first embodiment;

FIGS. 10A to 10D illustrate diagrams showing the allowable-error-power correcting unit in the encoding unit according to the first embodiment;

FIGS. 18A to 18C illustrate a diagram showing an encoding device according to the second embodiment;

DESCRIPTION OF THE PREFERRED EMBODIMENTS

[Consideration on Underlying Technology]

Figure 23C:
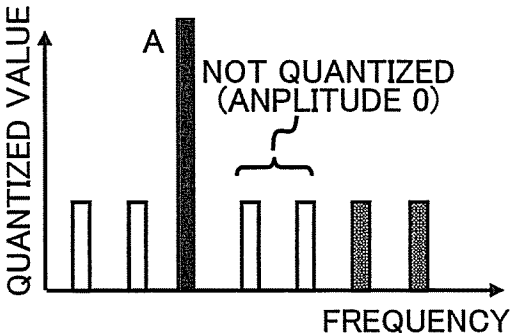
FIGS. 23A to 23C illustrate for showing the consideration on underlying technology.
Figure 23B:
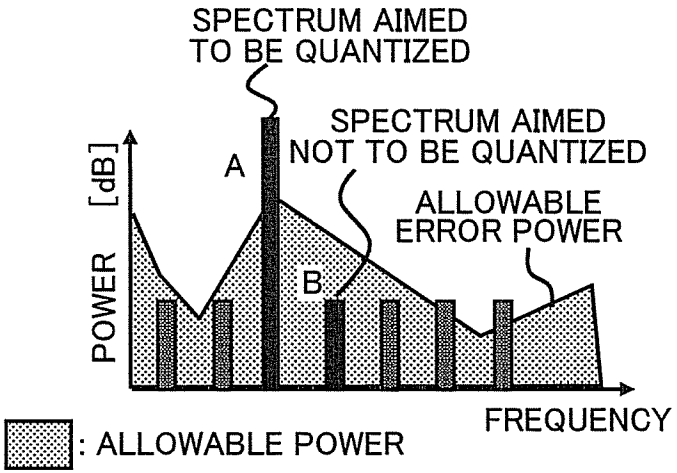
Figure 23A:
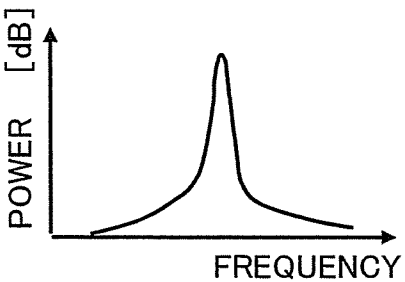

Referring to FIG. 23A to 23B, consideration over a conventional technology of coding an audio signal is described to make clear a shortcoming which is caused in quantization of frequency spectra adjacent to the peak of a tonal audio signal. When a tonal audio signal, e.g. a sinusoidal wave, a sweep wave, or the like, is encoded, intensities or power in dB concentrate in a specific band which exhibits a relatively large peak compared to other bands. That is, a specific band has frequency spectra having high intensities as shown in FIG. 23A which illustrates frequency spectra obtained by performing MDCT conversion on a tonal audio signal.

Also, as shown in FIG. 23B, in the conventional encoding device, an allowable error powers determined with respect to the bands adjacent to one including the peak also increased. Specifically, since the frequency spectra in the band including the peak are greater in power than other frequency spectra, the conventional encoding device also has large masking thresholds determined for the adjacent bands as well as the band including the peak. As a result, the allowable error powers also increase. Consequently, as shown in FIG. 23C, the frequency spectra in the bands adjacent to the peak become frequency spectra that are smaller than or equal to the allowable error powers. Since the frequency spectra in the adjacent bands are regarded as spectra not to be quantized, the frequency spectra are not quantized.

When an audio signal is transformed through MDCT, the resultant frequency spectra are composed with each of MDCT coefficients of which each contains information of the amplitude and the phase of the audio-signal, while each of FIG. 23A, 23B, and 23C illustrate only individual amplitudes. For example, when the frequency spectra adjacent to the peak are not quantized, information contained in the frequency spectra are lost. Therefore, the drops of the phase and the amplitude affect ones of a sound source associated with the peak and causes sound-quality deterioration, such as a sensation of trill. In particular, for a tonal audio signal, a sound source adjacent to a specific frequency in a band having the peak effectively contributes to a main sound source, and the influence due to the loss of the information contained in the frequency spectra adjacent to the peak is strongly exerted on the sound quality of an encoded sound source, compared to a low tonal audio signal.

Embodiments of an encoding device, an encoding method, and a program product including the method will be described below in detail with reference to the accompanying drawings. In the below, an underlying technology an overview, features, and a processing flow of the encoding device according to the first embodiment are described in order, and then, other embodiments are described.

[First Embodiment]

[Underling Technology]

First, an underlying technology for describing an encoding device according to a first embodiment will be described using FIGS. 1 to 4.

A term "frequency spectrum" corresponds to a coefficient e.g. an MDCT coefficient for each frequency obtained through converting an audio signal (a sound source) by e.g. MDCT into frequency domain. A term "frequency spectral power" corresponds to the value of the square of the frequency spectrum. A term "tonal frequency spectrum" is a coefficient for one frequency of frequency spectra when peaks of frequency spectral powers concentrate at the frequency. For example, a frequency spectrum having a greater power than the average of all frequency spectral powers corresponds to the tonal frequency spectrum. An audio signal corresponding to a conversion source of the "tonal frequency spectrum" is referred to as a "tonal sound source".

Also, a term "quantization" is processing for rounding down a numeric value after a decimal point (e.g., changing "1.8" and "2.1" to integers such as "1" and "2", respectively). A term "quantization value" indicates a value obtained by quantizing a frequency spectrum.

Figure 1:
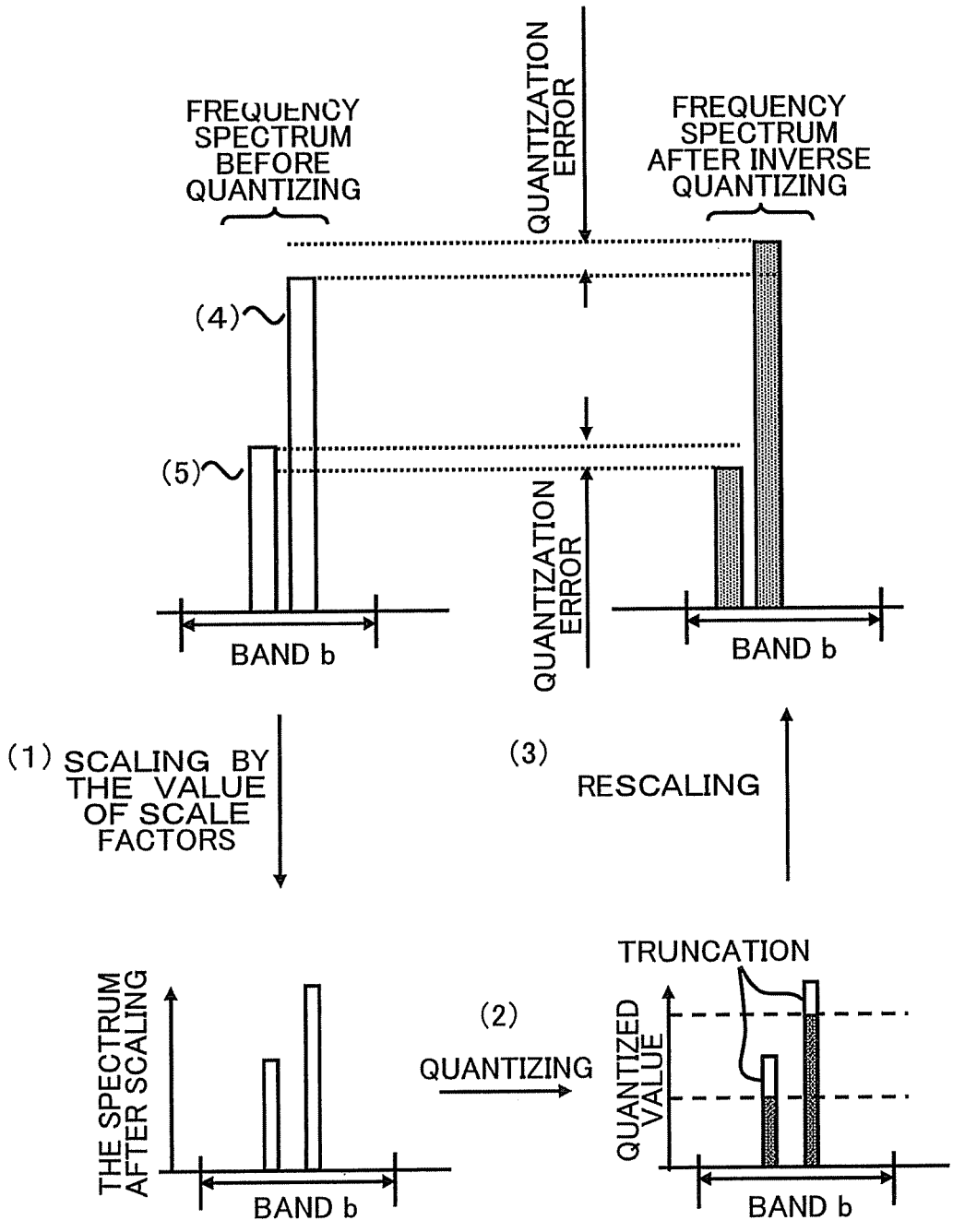
FIG. 1 illustrates a diagram showing the underlying technology of an encoding device according to a first embodiment.

A term "quantization error" is an error caused in each frequency spectrum by quantizing the frequency spectrum. Specifically, as shown in FIG. 1, the difference between a pre-quantization frequency spectrum and a post-inverse-quantization spectrum corresponds to the quantization error, where the post-inverse-quantization spectrum is referred to as an "inversely quantized spectrum".

Herein, the term "inversely quantized spectrum" is a frequency spectrum obtained from a quantization value. The relationship of a frequency spectrum, a quantization value, and an inversely quantized spectrum will be described. Through the series of processing described below, the encoding device quantizes frequency spectra to obtain quantization values and then obtains inversely quantized spectra from the quantization values. Since the dynamic range of the frequency spectra is usually large, the encoding device first performs scaling using a predetermined "scale factor" to reduce the range as shown at (1) in FIG. 1. Thereafter, as shown at (2) in FIG. 1, the encoding device performs quantization to obtain quantization values. Then, as shown at (3) in FIG. 1, the encoding device rescales (performs the reverse processing of the scaling performed at (1) in FIG. 1) the obtained quantization values by using the predetermined scale factor to obtain inversely quantized spectra.

In this case, the inversely quantized spectrum is given by an expression shown in Equation 1 shown in FIG. 2 and the quantization value is given by Equation 2 shown in FIG. 2. These equations are derived from Expression 1, which is an expression representing the relationship among the frequency spectrum, the quantization value, and the scale factor. "2^(scale factor)" indicates "2 raised to the power of scale factor."

Frequency Spectrum=Quantization Value×2^(scale factor) Expression 1:

A frequency range in which frequency spectra of an audio signal are analyzed is divided into a plurality of a smaller frequency range having a predetermined width in frequency as a band. To each of the bands, individual "scale factor" is given. For example, in the example shown in FIG. 1, one scale factor is given to a band "b" containing frequency spectra (4) and (5) shown in FIG. 1. The scale factor is determined by the encoding device so that the quantization error power is smaller than an allowable error power.

A term "band power" of frequency spectra refers to the sum of powers of frequency spectra contained in a band.

A term "quantization error power" of a frequency spectrum refers to the value of the square of a quantization error. Also, a quantization error power in one band refers to the sum of quantization error powers determined from quantization errors generated during quantization of frequency spectra contained in the band. Specifically, the relationship between a quantization error power and a quantization error in one band is given by Expression 2 where ^2 indicates a square.

Quantization Error Power in One Band=Σ{(Quantization Errors in Frequency Spectra Contained in the Band)^2}. Expression 2:

Also, the term "allowable error power" is a maximum quantization error power that is allowed during quantization. The allowable error power is an allowable maximum quantization error power in the quantization error powers caused during quantizing the scaled spectrum. More in detail, the allowable error power is derived for each band from a transformation of the masking threshold corresponding to the band, where the masking threshold that indicates whether or not it can be acoustically heard. As a scheme for determining the allowable error power from the masking threshold, for example, the scheme described in ISO/IEC 13818-7 may be used or other schemes may be used.

Specifically, the allowable error power is a "limit of an allowable quantization error power". For example, the allowable error power in one band is a quantization error power determined for the band and exhibits a maximum value that is allowed as an error generated during quantization of frequency spectra in the band. In other words, the encoding device according to the first embodiment quantizes frequency spectra so that the difference power between the power of pre-quantization frequency spectra and the power of inversely quantized spectra in one band is smaller than the allowable error power.

Also, the allowable error power for each band is derived from the individual masking thresholds. The derived allowable error power is also compared with individual power frequency spectra to select the frequency spectra to be quantized in which band. What are compared with the allowable error powers during determination of frequency spectra to be quantized are band powers.

Also, the term "encoding" is processing for converting the quantization values and/or the scale factors into other values (codes) by using, for example, Huffman coding.

The relationship between the scale factor and the quantization error power will be briefly described. As described above, each of scale factors is assigned to each band, and each frequency spectrum contained in one band is quantized using the assigned scale factor.

Figure 3A:
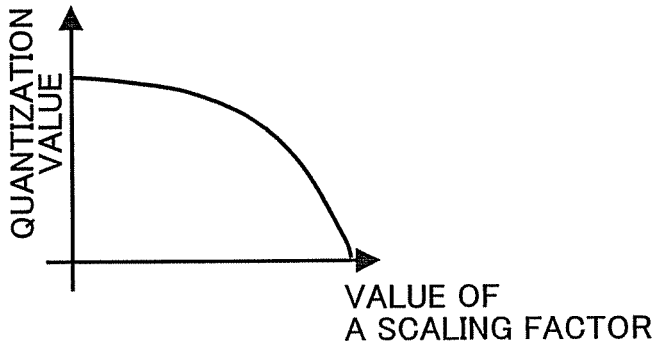
FIGS. 3A to 3C illustrate diagrams showing the underlying technology of an encoding device according to the first embodiment.

When attention is given to one frequency spectrum in a band, the relationship between the quantization value and the scale factor is given as shown in FIG. 3A and the relationships shown by Expression 3 and Expression 4 below hold.

Large Scale Factor⇔Small Quantization Value Expression 3

Small Scale Factor⇔Large Quantization Value Expression 4

Figure 3B:
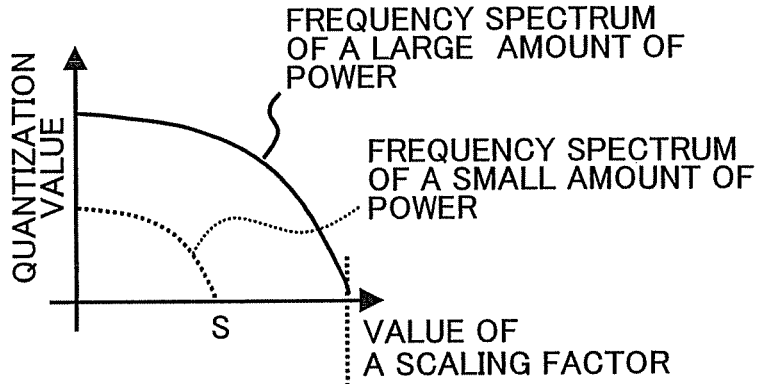

Attention is now given to frequency spectra contained in a band. As shown in FIG. 3B, when the scale factor is set to be large, the quantization value becomes "0" from a small-power frequency spectrum in the band and thus the quantization error increases.

Figure 3C:
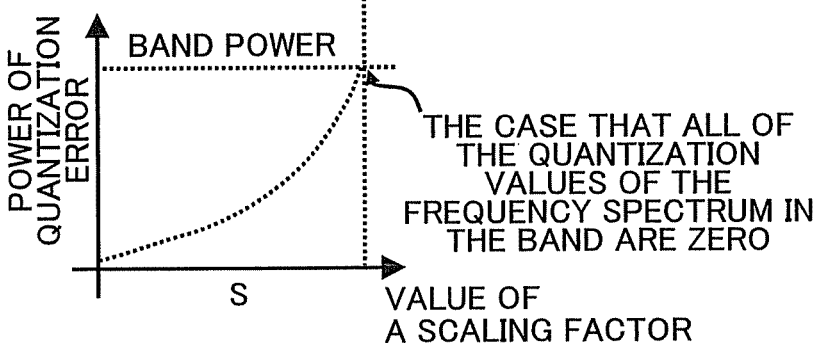

That is, as shown in FIG. 3C, the relationships in Expression 5 and Expression 6 below hold for the scale factor and the quantization error power.

Large Scale Factor⇔Small Quantization Value→Increase in Quantization Error Expression 5

Small Scale Factor⇔Large Quantization Value→Reduction Quantization Error Expression 6

When all frequency spectra contained in a band are quantized with a quantization value "0" (i.e., are not quantized), the quantization error power has a maximum value and the relationship in Expression 7 below holds.

Quantization Error Power=Band Power Expression 7

Figure 4:
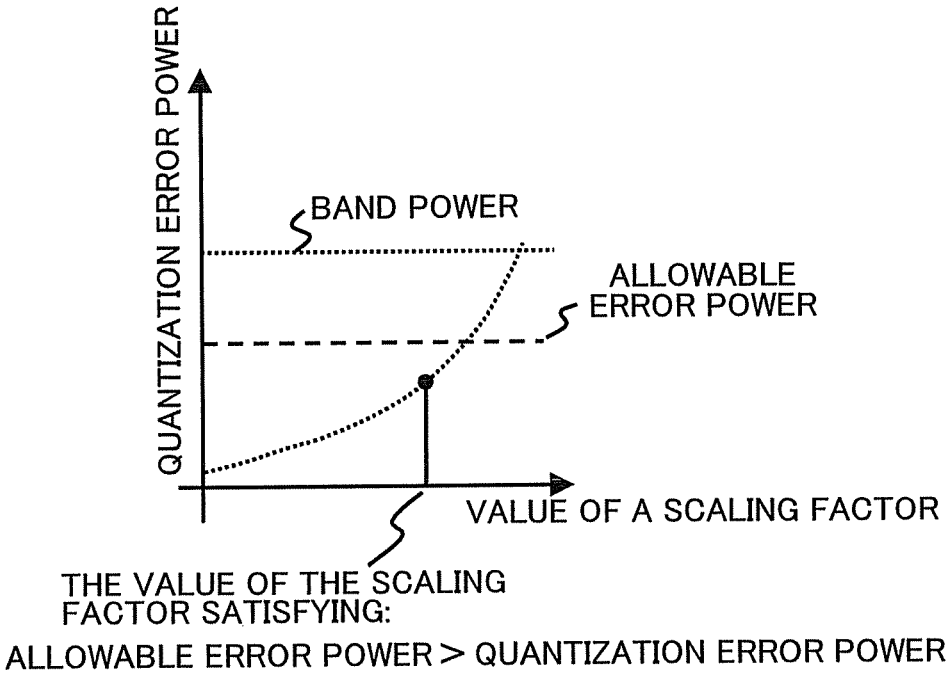
FIG. 4 illustrates a diagram showing the underlying technology of an encoding device according to the first embodiment.

Also, the relationship of the scale factor, the quantization error power, and the allowable error power will now be briefly described. First, when the band power is greater than the allowable error power, the encoding device regards the band as a band to be quantized. Also, as shown in FIG. 4, the encoding device quantizes the frequency spectra by using such a scale factor that the quantization error power becomes smaller than the allowable error power. Thus, as shown in FIG. 4, the encoding device performs quantization by using a scale factor that satisfies "Allowable Error Power>Quantization Error Power".

Now, the relationship of the quantization error power, the allowable error power, and the band power is summarized again. That is, the relationship is given by:

(1) the maximum value of the quantization error power is the band power (Expression 7), (2) the relationship in Expression 7 is given when all frequency spectra are quantized with a quantization value "0" (i.e., are not quantized), and (3) the quantization value is performed using a scale factor that satisfies a case of Allowable Error Power>Quantization Error Power (this is referred to as "Expression A"). Now, when the relationship in Expression 7 holds, Expression A is given by Expression B below.

Allowable Error Power>Quantization Error Power, where Quantization Error Power=Band Power. Expression B A case in which the band power equals to the quantization error power corresponds to a case in which the quantization values of the frequency spectra are "0" (i.e., the frequency spectra are not quantized). In other words, the allowable error power serves as a threshold for determining whether or not all frequency spectra in a band are to be quantized.

[Overview and Features of Encoding Device]

Figure 5:
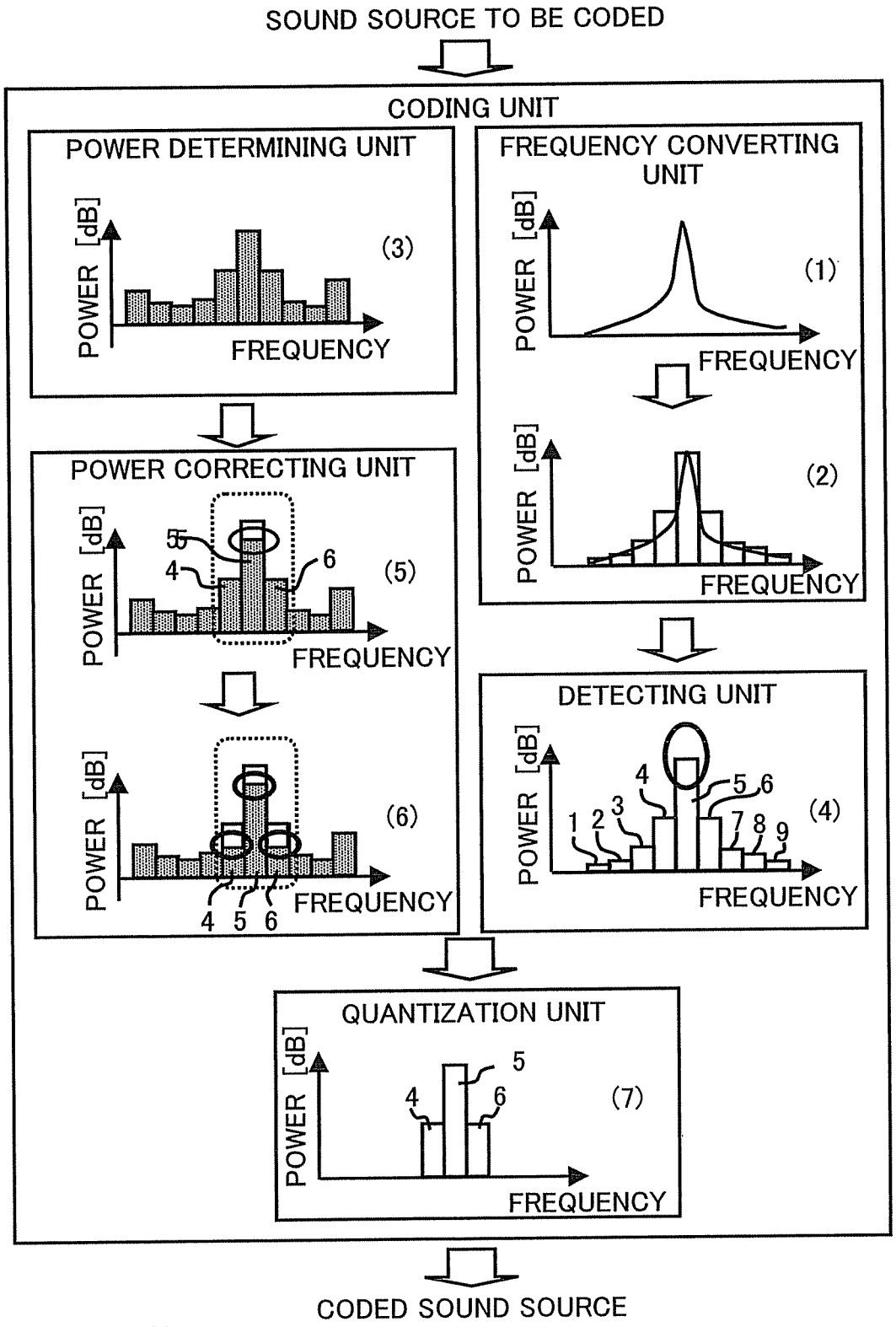
FIG. 5 illustrates a diagram showing the outline and configuration of an encoding device according to the first embodiment.

An overview and features of the encoding device according to the first embodiment will be described next using FIG. 5 illustrating an overview and features of the encoding device according to the embodiment.

FIG. 5 illustrates the encoding device in which several main units are provided and shown with a signal processed in the each unit for coding an audio signal. When a sound source (an audio signal) to be encoded is input into the encoding device, the device encodes the audio signal as shown in FIG. 5. The encoding device has a main feature in that it can improve the encoded-sound quality of a tonal audio signal, as described below.

That is, a frequency converting unit converts the inputted audio signal into frequency spectra as shown in (1) in FIG. 5. The frequency converting unit determines the powers of the frequency spectra for each of bands having a predetermined width in frequency as shown in (2) in FIG. 5. For example, the frequency converting unit determines the total of powers (the band power) corresponding to a sum of the individual powers of each frequency spectrum contained in a band. In the example shown in (2) in FIG. 5, each unpainted bar indicates frequency spectra in each band.

As shown in (3) in FIG. 5, the power determining unit determines allowable error powers for respective bands in accordance with the audio signal, (refer to the above-described [Underlying Technology]). In the example shown in (3) in FIG. 5, each bar painted indicates the allowable error power in each band (on a band basis).

A detecting unit, as shown in (4) in FIG. 5, detects a tonal frequency spectrum from the frequency spectra converted by the frequency converting unit and also detects a band containing the tonal frequency spectrum. For example, the detecting unit detects a band "5" in (4) in FIG. 5 as a band containing a tonal frequency spectrum.

Then, a power correcting unit corrects the allowable error powers using both of the result detected by the detecting unit and the allowable error powers determined by the power determining unit. Specifically, each of the allowable error powers of the bands adjacent to the band containing the tonal frequency spectrum are individually corrected by the power correcting unit so that the allowable error power become smaller than the sum of powers of frequency spectra in the bands.

As shown in (5) in FIG. 5, the power correcting unit corrects the powers of frequency spectra of the bands "4" and "6" adjacent to the band "5" so that the allowable error power of each of the bands "4" and "6" become smaller than each of the powers of the frequency spectra of the bands "4" and "6". To clarify the correction, the painted portion in the bars in the bands "4" and "6" in (6) in FIG. 5 shows the corrected allowable error powers for each of the bands. Namely in (6) in FIG. 5, each of unpainted portions in the band "4" and "6" illustrates the amounts corrected by the power correcting unit.

Then, in the encoding device, as shown in (7) in FIG. 5, a quantizing unit quantizes frequency spectra having greater powers than the allowable error powers corrected by the power correcting unit. For example, the quantizing unit quantizes the frequency spectra contained in the band "5" containing the tonal frequency spectrum and the frequency spectra contained in the bands "4" and "6" that have allowable error powers corrected by the power correcting unit as shown in (7) in FIG. 5.

Specifically, since the allowable error powers are corrected so that the frequency spectra that exist adjacent to a peak power are quantized, it is possible to reliably quantize the frequency spectra that exist adjacent to the peak power and it is possible to improve the encoded-sound quality of a tonal audio signal.

[Configuration of Encoding Device]

Figure 6:
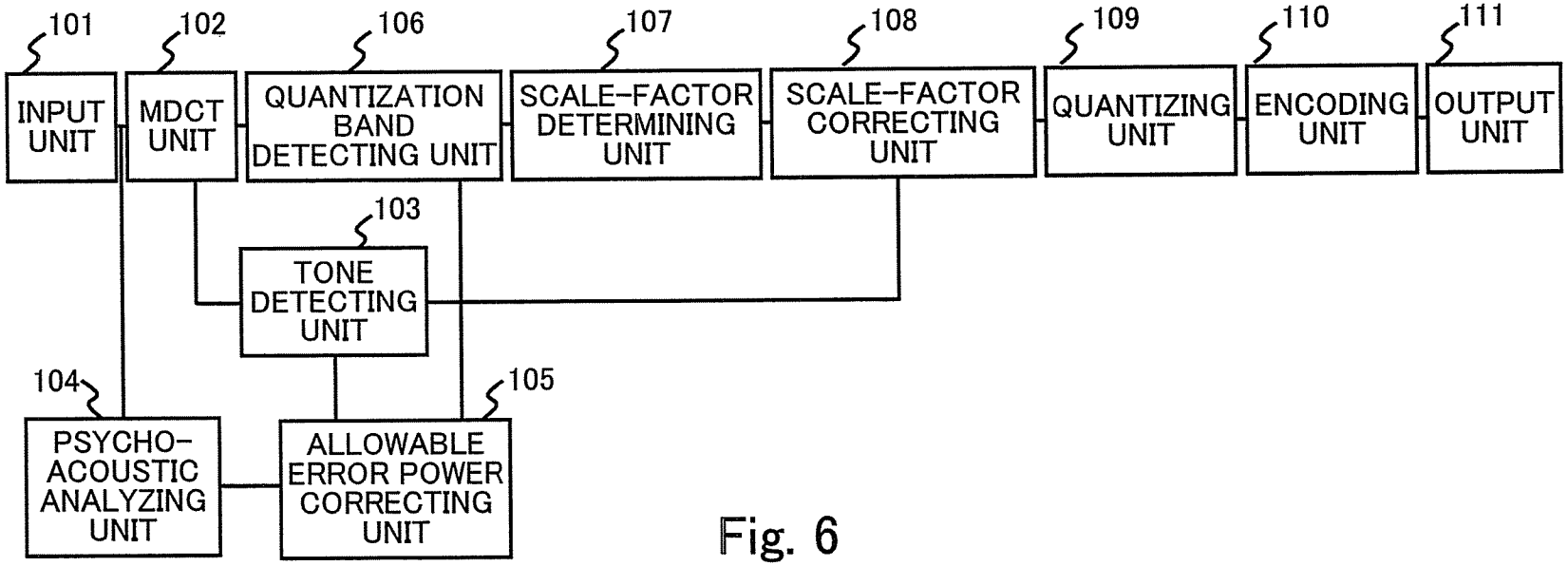
FIG. 6 illustrates a block diagram showing the configuration of the encoding device according to the first embodiment.
Figure 8B:
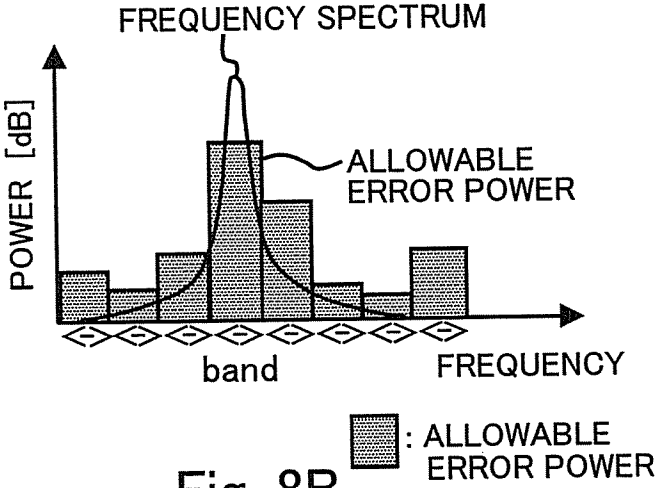
FIGS. 8A and 8B illustrate diagrams showing a psychoacoustic analyzing unit in the encoding device according to the first embodiment.

The configuration of the encoding device shown in FIG. 5 will be described next using FIGS. 6 to 11. Here, FIG. 6 is a block diagram showing the configuration of the encoding device according to the first embodiment. FIG. 7 is a drawing for describing a tone detecting unit in the first embodiment. FIG. 8 is a drawing for describing a psychoacoustic analyzing unit in the first embodiment. FIG. 9 is a drawing for describing an allowable-error-power correcting unit in the first embodiment. FIG. 10 is a drawing for describing the allowable-error-power correcting unit in the first embodiment. FIG. 11 is a diagram for describing a scale factor correcting unit in the first embodiment.

As shown in FIG. 6, the encoding device includes, an input unit 101, a Modified Discrete Cosine Transform (MDCT) unit 102, a tone detecting unit 103, a psychoacoustic analyzing unit 104, an allowable-error-power correcting unit 105, a quantization-band detecting unit 106, a scale factor determining unit 107, a scale factor correcting unit 108, a quantizing unit 109, an encoding unit 110, and an output unit 111.

The MDCT unit 102, the psychoacoustic analyzing unit 104, and the tone detecting unit 103 may correspond to a "frequency converting unit", a "power determining unit", and a "detecting unit" respectively. Further the allowable-error-power correcting unit 105 and the quantizing unit 109 may correspond to a "power correcting unit" and a "quantizing unit" respectively. The scale factor determining unit 107 may correspond to a "first scale factor determining unit" and a "second scale factor determining unit". The scale factor correcting unit 108 may correspond to a "third scale factor determining unit".

An audio signal as a sound source to be encoded is received by the input unit 101 and then fed to the MDCT unit 102 and the psychoacoustic analyzing unit 104 both of which are described below.

The MDCT unit 102 converts the audio signal, transmitted from the input unit 101, into frequency spectra. Specifically, through MDCT conversion, the MDCT unit 102 performs time-frequency conversion by which the audio signal transmitted from the input unit 101 is converted into frequency spectra. The time-frequency conversion herein means, for example, a conversion of an audio signal as a function of time variable into frequency spectra of frequency variable.

The MDCT unit 102 determines the power of frequency spectra for each of bands obtained by dividing a whole predetermined width of the frequency spectra by a predetermined band width in frequency. For example, in the example shown in FIG. 7A, the frequency spectra within a width W are divided into seven sub-bands indicated as bands "0" to "6" and the sum of the powers of the frequency spectra contained in each band is determined as a band power such as $E_0$ to $E_6$.

Also, the MDCT unit 102 transmits data of the converted frequency spectra and the band powers to both of the tone detecting unit 103 and the quantization-band detecting unit 106 described below.

Upon receiving the data of the frequency spectra from the MDCT unit 102, the tone detecting unit 103 analyzes a tonality with respect to the frequency spectra, detects a tonal frequency spectrum, and detects a band containing the tonal frequency spectrum.

Also, for example, as shown in FIG. 7B, the tone detecting unit 103 determines an average value of the powers in all bands (in other words, an average value of the powers of all frequency spectra) from the determined powers in the respective bands. Specifically, when the number of bands (the number of divided bands) is indicated by "band" (e.g., "band" is 7 in the example shown in FIG. 7B) and each band power is indicated by "$E_{band}$", the tone detecting unit 103 determines an average power "$E_{ave}$" of the frequency spectra in all the bands in accordance with an expression shown in FIG. 7C.

Also, as shown in FIG. 7D, the tone detecting unit 103 determines that a band is a tonal band when the band has a power averaged over its band width and the averaged power is greater than a threshold, where the threshold is a power averaged over a whole range to be calculated. Specifically along an example shown in FIG. 7B, the tone detecting unit 103 detects the band 3 as a band containing a tonal frequency spectrum, because the band 3 is a band having an average power of frequency spectra which is greater than the determined average power $E_{ave}$.

Also, the tone detecting unit 103 transmits the data of the detected band containing the tonal frequency spectrum to both of the allowable-error-power correcting unit 105 and the scale factor correcting unit 108 described below. Furthermore, the tone detecting unit 103 transmits information of a flag and information for identifying the detected band, which indicated tone_flag and tone_band respectively. The flag as tone_flag indicates that a tonality is detected, and the information as tone_band indicates the band 3 having a band power $E_3$ in the example shown in FIG. 7B. The information of both of tone_flag and tone_band are sent to the allowable-error-power correcting unit 105 and the scale factor correcting unit 108 described below. When the tone detecting unit 103 does not detect a band containing a tonal frequency spectrum, the unit 103 does not transmit the information of tone_flag and tone_band.

The tone detecting unit 103 transmits also data of the frequency spectra and the band powers, which received from the MDCT unit 102, to the allowable-error-power correcting unit 105 described below.

Upon receiving the audio signal from the input unit 101, the psychoacoustic analyzing unit 104 determines allowable error powers in accordance with the audio signal (refer to the underlying technology). The psychoacoustic analyzing unit 104 divides a predetermined band width of frequency included in the audio signal into smaller predetermined-width bands and determines allowable error powers for the respective divided bands, while it is preferable to use the bands determined by the MDCT unit 102.

Figure 8A:
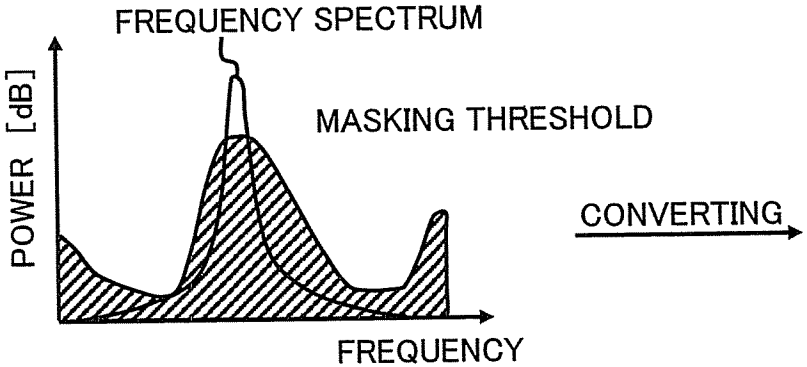
Figure 9:
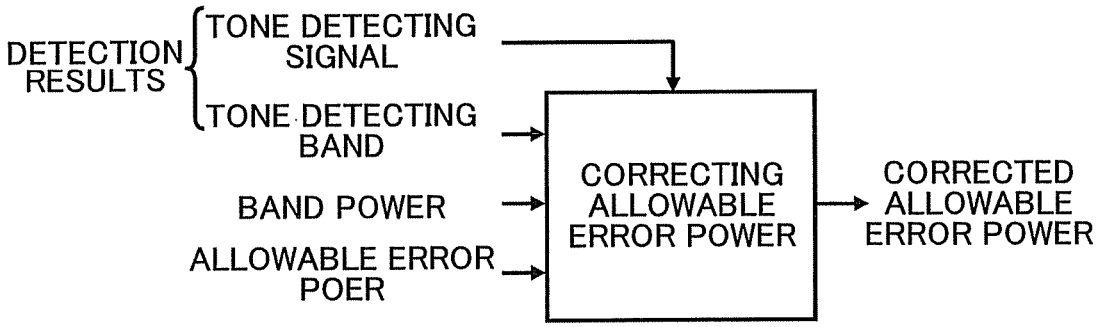
FIG. 9 illustrates a diagram showing an allowable-error-power correcting unit in the encoding device according to the first embodiment.

As shown in FIG. 8A, the psychoacoustic analyzing unit 104 determines a masking threshold for the audio signal transmitted from the input unit 101. Also, as shown in FIG. 8B, the unit 104 converts the determined masking threshold to determine allowable error powers.

The term "bands" referred to herein correspond to the bands used by the MDCT unit 102. In other words, the psychoacoustic analyzing unit 104 determines preferably an allowable error power for each band using of the bands and the respective band power determined by the MDCT unit 102. In, for easy understanding, each of FIG. 8A and 8B illustrates the masking threshold or the allowable error powers in conjunction with the frequency spectra.

The psychoacoustic analyzing unit 104 also transmits the data of the determined allowable error powers to the allowable-error-power correcting unit 105 described below.

The allowable-error-power correcting unit 105 has the number-of-bands storing unit (not shown in FIG. 6) for storing the predetermined number of bands. As shown in FIG. 9, the allowable-error-power correcting unit 105 receives the detection results of "tone_band" and "tone_flag" from the tone detecting unit 103; the data of allowable error powers from the psychoacoustic analyzing unit 104; and the data of band powers also from the tone detecting unit 103. "tone_band" and "tone_flag" are shown as "Detection Result" in the example shown in FIG. 9. Using the detection results and the data of the band powers, the allowable-error-power correcting unit 105 corrects the data of the allowable error powers. The number-of-bands storing unit may correspond to a "number-of-bands storing unit".

Specifically, it is performed in the allowable-error-power correcting unit 105 so that the allowable error powers determined by the psychoacoustic analyzing unit 104 with respect to bands adjacent to the band detected by the tone detecting unit 103 become smaller than the band powers with respect to the adjacent bands.

For example, the allowable-error-power correcting unit 105 detects, as adjacent bands, bands located in the range of a predetermined number of bands which is stored by the number-of-bands storing unit, with the band that contains the tonal frequency spectrum detected by the tone detecting unit 103 being as the center thereof.

An example of a case in which the tone detecting unit 103 detects the "b"th band and a predetermined bandwidth stored in the number-of-bands storing unit is a correction bandwidth "B" will be specifically described by way of example. As shown in FIG. 10A, the allowable-error-power correcting unit 105 detects "B" bands adjacent to the band "b" as adjacent bands to be corrected, with the "b"th band being as the center thereof. In other words, the allowable-error-power correcting unit 105 detects the "b-B"th to "b+B"th bands as adjacent bands to be corrected. For example, in the example shown in FIG. 10A, for "b=16" and "B=4", the allowable-error-power correcting unit 105 detects bands "12" to "20" as adjacent bands to be corrected.

Also, as shown in FIG. 10B, the allowable-error-power correcting unit 105 corrects the allowable error powers with respect to the detected adjacent bands. In the shown in FIG. 10B, the pre-correction allowable error powers in the bands "12" to "20" (excluding the band "16"), which are the detected adjacent bands, are greater than the band powers in the detected adjacent bands. Thus, the allowable-error-power correcting unit 105 performs correction by equally attenuating the allowable error powers in the bands "12" to "20" (excluding the band "16") so that the allowable error powers become smaller than the powers in the frequency spectra. One of methods for the attenuation determines "M'b−1=g×Mb−1" (Amount of Attenuation "g"<1.0) as shown in FIG. 10C, where "M'b−1" indicates a post-correction allowable error power in the "b−1"th band and "Mb−1" indicates a pre-correction allowable error power in the "b−1"th band.

The allowable-error-power correcting unit 105 also transmits to the quantization-band detecting unit 106; the data of the allowable error powers determined by the psychoacoustic analyzing unit 104; and the data of the corrected allowable error. When the allowable-error-power correcting unit 105 does not receive the flag (tone_flag) and the information for identifying the detected band from the tone detecting unit 103, the correcting unit 105 does not perform the processing for correcting the allowable error powers and transmits the allowable error powers determined by the psychoacoustic analyzing unit 104 to the quantization-band detecting unit 106 described below.

The quantization-band detecting unit 106 detects bands to be quantized from the band of the frequency spectra when received the frequency spectra and the allowable error powers. The frequency spectra is from the MDCT unit 102 and the allowable error powers (including the allowable error powers corrected by the allowable-error-power correcting unit 105) from the allowable-error-power correcting unit 105.

Specifically, the quantization-band detecting unit 106 compares, on a band-to-band basis, the band powers transmitted from the MDCT unit 102 with the allowable error powers transmitted from the allowable-error-power correcting unit 105. Accordingly bands to be quantized are determined. More specifically, with respect to a band having an allowable error power corrected by the allowable-error-power correcting unit 105, the quantization-band detecting unit 106 compares the corrected allowable error power with the band power of the band. Also, with respect to a band that have not an allowable error power corrected by the unit 105, the unit 106 compares the allowable error power determined by the psychoacoustic analyzing unit 104 with the band power of the band. The unit 106 also detects, as a band to be quantized, each band indicating a greater band power than the allowable error power. The unit 106 also detects information for identifying the detected bands.

The quantization-band detecting unit 106 also transmits to the scale factor determining unit 107 the information for identifying the detected bands to be quantized; the data of the allowable error powers transmitted from the allowable-error-power correcting unit 105; and the data of the frequency spectra transmitted from the MDCT unit 102.

Upon transmission of the information for identifying the bands to be quantized, the allowable error powers, and the frequency spectra from the quantization-band detecting unit 106, the scale factor determining unit 107 determines, for respective bands, such scale factors that the quantization error powers become smaller than the allowable error powers.

When the allowable-error-power correcting unit 105 corrects the allowable error powers with respect to bands adjacent to the band containing the tonal frequency spectrum detected by the tone detecting unit 103, the scale factor determining unit 107 determines such scale factors that the quantization error powers become smaller than the corrected allowable error powers with respect to the adjacent bands.

The scale factor determining unit 107 also transmits the information for identifying the bands to be quantized; and the sets of data of the allowable error powers, the frequency spectra, and the scale factors determined for the respective bands to the scale factor correcting unit 108 described below.

Figures 11A, 11B:
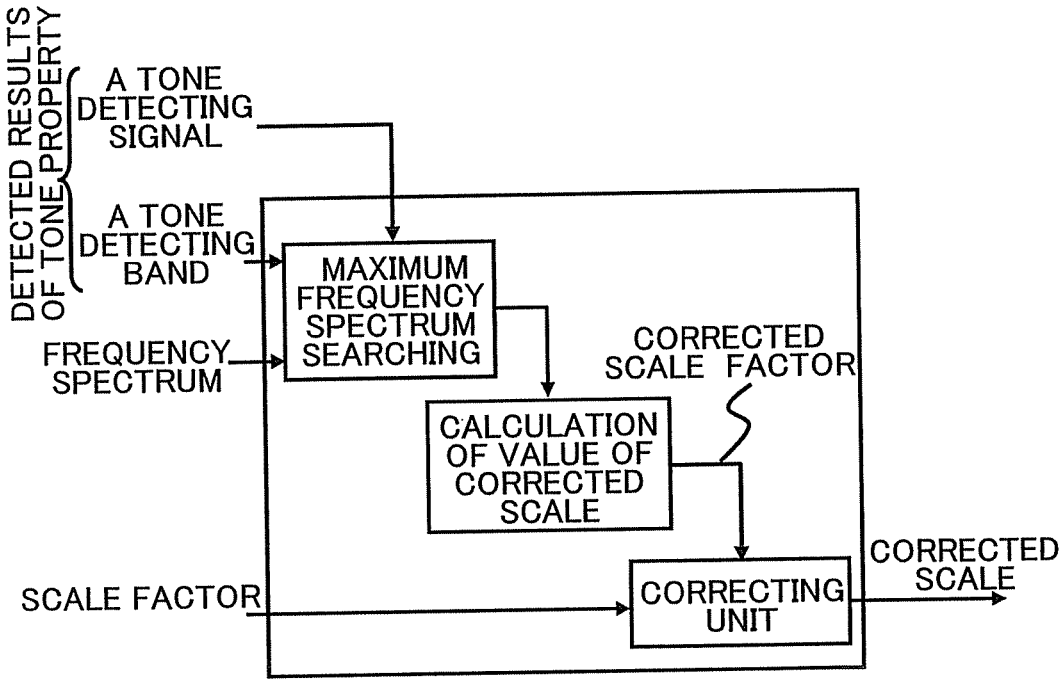
FIGS. 11A and 11B illustrate diagrams showing a scale factor correcting unit in the encoding unit according to the first embodiment.

As shown in FIG. 11A, the scale factor correcting unit 108 receives the data of tonality detection result from the tone detecting unit 103; the information for identifying the bands to be quantized, and the each sets of data of the allowable error powers (the information and the allowable error powers are not shown in FIG. 11), the frequency spectra, and the scale factors for the respective bands from the scale factor determining unit 107. Upon receiving these data, the scale factor correcting unit 108 corrects the scale factor of the band containing the tonal frequency spectrum. As described above, the tonality detection result includes the data of the band containing the tonal frequency spectrum and the tone detecting signal. In particular, the scale factor correcting unit 108 corrects the scale factor for the band containing the tonal frequency spectrum to such a scale factor that the quantization value obtained from a largest one of the frequency spectra that constitute the band becomes the maximum value of the quantization values.

Now, a description will be specifically given of an example of a case in which the band containing the tonal frequency spectrum is a band "b" and the scale factor determined by the scale factor determining unit 107 with respect to the band "b" is "Sb". The scale factor correcting unit 108 searches for the maximum frequency spectrum contained in the band "b" ("Maximum Frequency Spectrum Searching" corresponds thereto, in the example shown in FIG. 11A). The maximum frequency spectrum is referred to as "max_pow_spec", and the term "maximum frequency spectrum" referred to herein means the greatest-power frequency spectrum of the frequency spectra that constitute the band containing the tonal frequency spectrum.

Also, for example, upon detecting the maximum frequency spectrum, the scale factor correcting unit 108 determines such a scale factor "S'b" that the quantization value obtained by quantizing the maximum frequency spectrum becomes "MAX_QUANT". "MAX_QUANT" means the maximum value of the quantization values. The scale factor "S'b" is determined in "Corrected Scale-Value Determination" in the example shown in FIG. 11A, and is set as a scale factor for the band containing the tonal frequency spectrum detected by the tone detecting unit 103. For example, in accordance with an expression shown in FIG. 11B, the scale factor correcting unit 108 replaces the scale factor "Sb" with the scale factor "S'b", that is, the scale factor "Sb" is corrected to the scale factor "S'b". The maximum value of the quantization value is a value defined by a coding technology standard, and MAX_QUANT=8191 is defined in the standard of Advanced Audio Coding (AAC).

The scale factor correcting unit 108 also transmits to the quantizing unit 109 the information for identifying the bands to be quantized; the each set of the allowable error powers, the frequency spectra, and the scale factors for the respective bands. The data of the scale factors includes the scale factor detected by the scale factor correcting unit 108 for the band containing the tonal frequency spectrum.

Upon receiving the information for identifying the bands to be quantized; each data set of the allowable error powers, the frequency spectra, and the scale factors for the respective bands, the quantizing unit 109 quantizes each frequency spectrum having a greater power than the allowable error power. Specifically, with respect to each of the bands detected by the quantization-band detecting unit 106, the quantizing unit 109 reduces the dynamic ranges of the frequency spectra to dynamic ranges uniquely specified by the scale factors and quantizes each of the frequency spectra that constitute each band in the reduced dynamic range. In this process, each of the bands detected by the quantization-band detecting unit 106 is identified by the information for identifying the bands to be quantized.

More specifically, the quantizing unit 109 quantizes each of the frequency spectra contained in the band whose scale factor was determined by the scale factor correcting unit 108, by using the scale factor determined by the scale factor correcting unit 108. Furthermore, the quantizing unit 109 quantizes each of the frequency spectra contained in the bands whose scale factors were not determined by the scale factor correcting unit 108, by using the scale factor determined by the scale factor determining unit 107.

In this case, the quantizing unit 109 uses the scale factors, determined by the scale factor determining unit 107 and the scale factor correcting unit 108, to change the dynamic ranges on a band-by-band basis (for each band). Thereafter, during execution of the quantization, the quantizing unit 109 performs the quantization on a frequency-spectrum by frequency-spectrum basis (for each frequency spectrum) that constitutes each of the bands, rather than performing quantization on a band-by-band basis. That is, the quantizing unit 109 obtains quantization values for respective frequency spectrum.

The quantizing unit 109 also transmits the data of the quantization values obtained by the quantization, and the scale factors to the encoding unit 110 described below.

Upon receiving the quantization values and the scale factors from the quantizing unit 109, the encoding unit 110 encodes the quantization values and the scale factors. For example, the encoding unit 110 uses Huffman coding to individually encode the quantization values and the scale factors. The encoding unit 110 transmits the encoded information to the output unit 111 described below.

Upon receiving of the encoded information from the encoding unit 110, the output unit 111 outputs the information received from the encoding unit 110, as encoded information of the audio signal input by the input unit 101.

The encoding device can also be realized by incorporating the functions of the MDCT unit 102, the tone detecting unit 103, the psychoacoustic analyzing unit 104, the allowable-error-power correcting unit 105, the quantization-band detecting unit 106, the scale factor determining unit 107, the scale factor correcting unit 108, and the quantizing unit 109, which are described above, into an information processing apparatus, such as a known personal computer, workstation, portable phone, PHS terminal, mobile communication terminal, or PDA.

[Processing Performed by Encoding Device]

Figure 12:
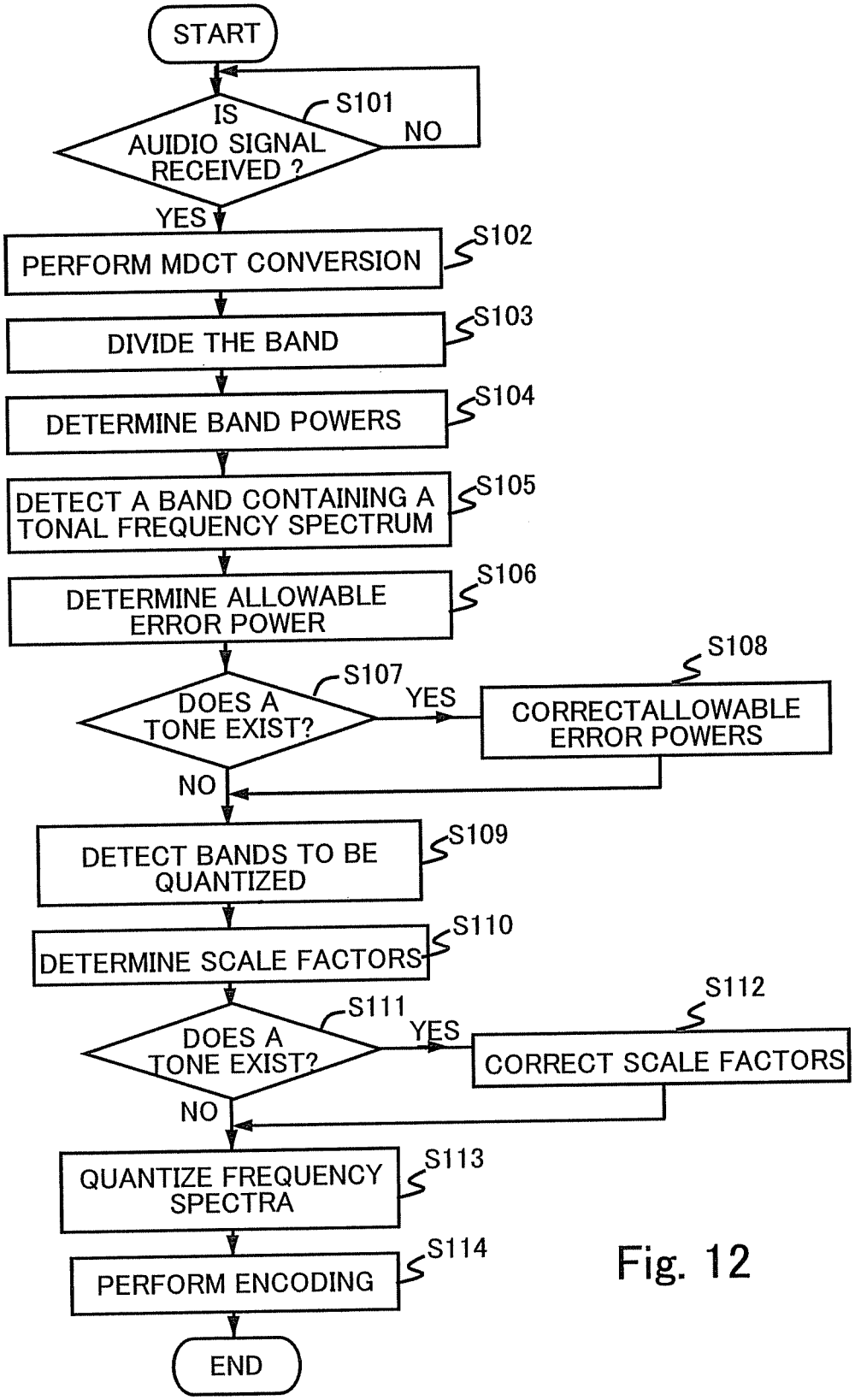
FIG. 12 illustrates a flowchart showing a flow of processing of the encoding device according to the first embodiment.
Figure 13:
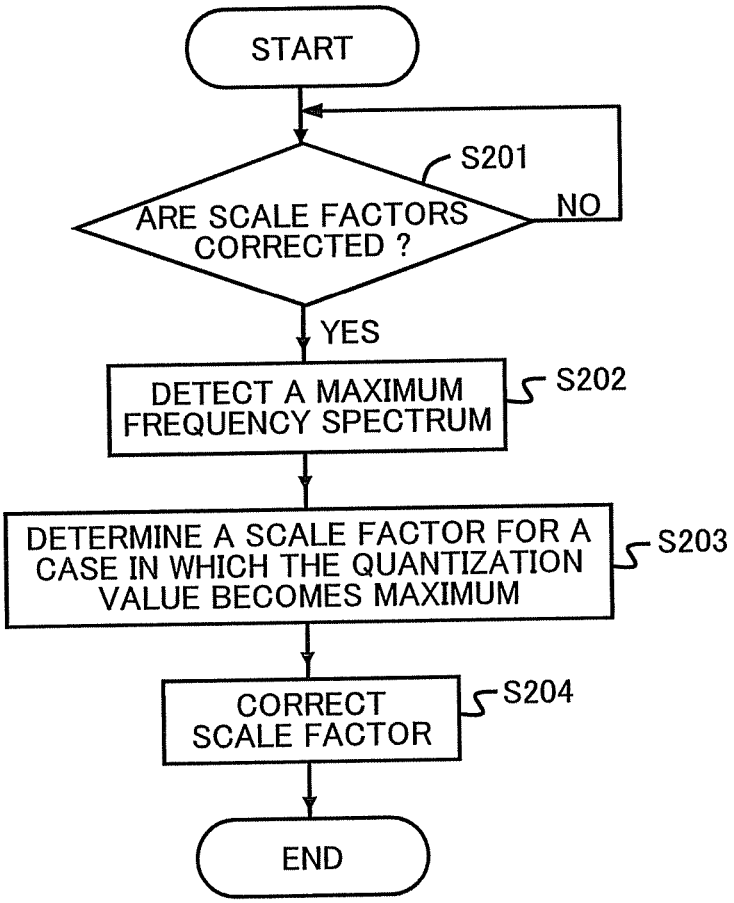
FIG. 13 illustrates a flowchart showing a flow of processing performed by the scale factor correcting unit of the encoding device according to the first embodiment.

Processing performed by the encoding device will be described next using FIGS. 12 and 13. Here, the flow of entire processing performed by the encoding device is first described using FIG. 12, and then, the flow of processing performed by the scale factor correcting unit 108 is described using FIG. 13. FIG. 12 is a flowchart showing the flow of entire processing of the encoding device according to the first embodiment and FIG. 13 is a flowchart showing the flow of processing performed by the scale factor correcting unit according to the first embodiment.

[Entire Processing Performed by Encoding Device]

As shown in FIG. 12, in the disclosed encoding device, when an audio signal exists (YES in step S101), i.e., when an audio signal is received by the input unit 101, the MDCT unit 102 performs MDCT conversion (step S102). That is, the MDCT unit 102 converts the audio signal, transmitted from the input unit 101, into frequency spectra. The MDCT unit 102 then divides the band (step S103) and determines band powers (step S104). That is, the MDCT unit 102 determines frequency spectral powers and further determines the sum of frequency spectral powers in each of the bands obtained by division by a predetermined width.

The tone detecting unit 103 then detects a band containing a tonal frequency spectrum (step S105). That is, when there is a band having a greater frequency spectral power than a threshold, which is the average power of the frequency spectra in all the bands, the tone detecting unit 103 detects the band as a band having a high tonality.

The psychoacoustic analyzing unit 104 then determines allowable error powers (step S106). That is, upon transmission of the audio signal from the input unit 101, the psychoacoustic analyzing unit 104 determines allowable error powers in accordance with the audio signal.

In this case, when a tone exists (YES in step S107), in other words, when the tone detecting unit 103 detects a tonal band in step S105 described above, the allowable-error-power correcting unit 105 corrects the allowable error powers (step S108). That is, upon transmission of the detection result from the tone detecting unit 103, the allowable-error-power correcting unit 105 corrects the allowable error powers with respect to adjacent bands. For example, the allowable-error-power correcting unit 105 corrects the allowable error powers with respect to adjacent bands to allowable error powers that are smaller than the band powers with respect to the adjacent bands.

Thus, the allowable-error-power correcting unit 105 corrects the allowable error powers (step S108). Alternatively, when no tone exists (NO in step S107), the quantization-band detecting unit 106 detects bands to be quantized (step S109). That is, upon transmission of the frequency spectra from the MDCT unit 102 and transmission of the allowable error powers from the allowable-error-power correcting unit 105, the quantization-band detecting unit 106 detects bands to be quantized from the bands of the frequency spectra.

The scale factor determining unit 107 then determines scale factors (step S110). That is, upon transmission of the information for identifying the bands to be quantized, the allowable error powers, and the frequency spectra from the quantization-band detecting unit 106, the scale factor determining unit 107 determines, for each band, such a scale factor that the quantization error power becomes smaller than or the allowable error power.

In this case, when a tone exists (affirmative in step S111), the scale factor correcting unit 108 corrects the scale factor (step S112). That is, when the band containing the tonal frequency spectrum is transmitted from the tone detecting unit 103 and the information for identifying the bands to be quantized, the allowable error powers, the frequency spectra, and the scale factors for the respective bands are transmitted from the scale factor determining unit 107, the scale factor correcting unit 108 corrects the scale factor for the band containing the tonal frequency spectrum.

The scale factor correcting unit 108 then corrects the scale factor (step S112). Alternatively, when no tone exists (negative in step S111), the quantizing unit 109 quantizes the frequency spectra (step S113). That is, upon transmission of the information for identifying the bands to be quantized, the allowable error powers, the frequency spectra, and the scale factors for the respective bands from the scale factor correcting unit 108, the quantizing unit 109 quantizes each frequency spectrum in each band detected by the quantization-band detecting unit 106.

Then, the encoding unit 110 performs encoding (step S114). That is, upon transmission of quantization values obtained by the quantization from the quantizing unit 109, the encoding unit 110 encodes the quantization values.

[Processing Performed by Scale-Value Correcting Unit]

As shown in FIG. 13, in the disclosed encoding device, when the scale factors are corrected (YES in step S201), i.e., when the band containing the tonal frequency spectrum is transmitted from the tone detecting unit 103 and the information for identifying the bands to be quantized, the allowable error powers, the frequency spectra, and the scale factors for the respective bands are transmitted from the scale factor determining unit 107, the scale factor correcting unit 108 detects a maximum frequency spectrum (step S202).

Then, for example, the scale factor correcting unit 108 determines a scale factor for a case in which the quantization value becomes maximum (step S203). That is, the scale factor correcting unit 108 determines such a scale factor that a quantization value obtained from a largest one of the frequency spectra that constitute the band containing the tonal frequency spectrum detected by the tone detecting unit 103 becomes a maximum value.

The scale factor correcting unit 108 then corrects the scale factor (step S204). That is, the scale factor correcting unit 108 corrects the scale factor determined by the scale factor determining unit 107 to the scale factor determined with respect to the band from which the tonal frequency spectrum was detected.

As described above, according to the first embodiment, the disclosed encoding device converts an audio signal into frequency spectra, determines allowable error powers for respective bands obtained by dividing the frequency of the audio signal by a predetermined width. The encoding device also detects a tonal frequency spectrum from the frequency spectra and a band containing the frequency spectrum. Using the detection result and the allowable error powers, the encoding device performs correction such that the allowable error powers determined with respect to bands adjacent to the band detected by the detecting unit become smaller than the powers of the frequency spectra with respect to the adjacent bands. Furthermore the encoding device quantizes each of the frequency spectra having greater powers than the corrected allowable error powers. Thus, it can be possible to improve the encoded-sound quality of a tonal audio signal.

Specifically, since the allowable error powers are corrected so that each of frequency spectra that exist adjacent to a peak power is corrected, it can be possible to reliably quantize each of the frequency spectra that exist adjacent to the peak power. Furthermore, it can be possible to improve the encoded-sound quality of a tonal audio signal.

Figure 14A:
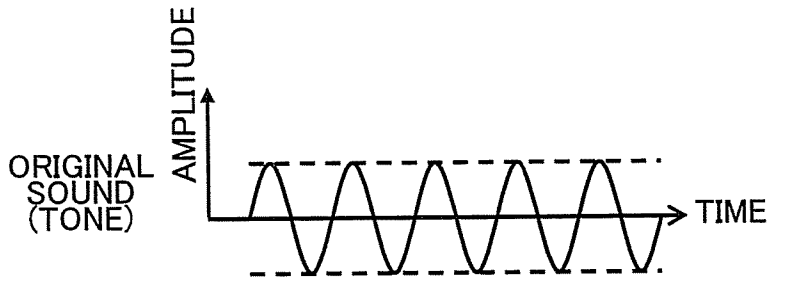
FIG. 14A illustrates a waveform of an audio signal.
Figure 14B:
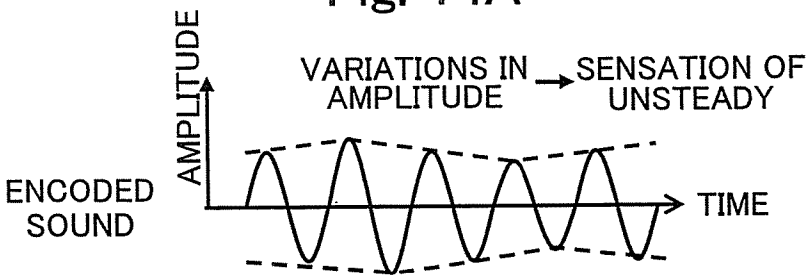
FIG. 14B illustrates an encoded signal.

That is, when a tonal audio signal is to be encoded in the known schemes, frequency spectra adjacent to a tonal frequency spectrum cannot be reliably quantized and the adjacent frequency spectra are lost. Consequently, in an original sound as shown in FIG. 14A, the phase characteristic of an encoded sound is distorted as shown in FIG. 14B, which may cause the amplitude to fluctuate and cause the sound to vibrate or the trill.

Figure 14C:
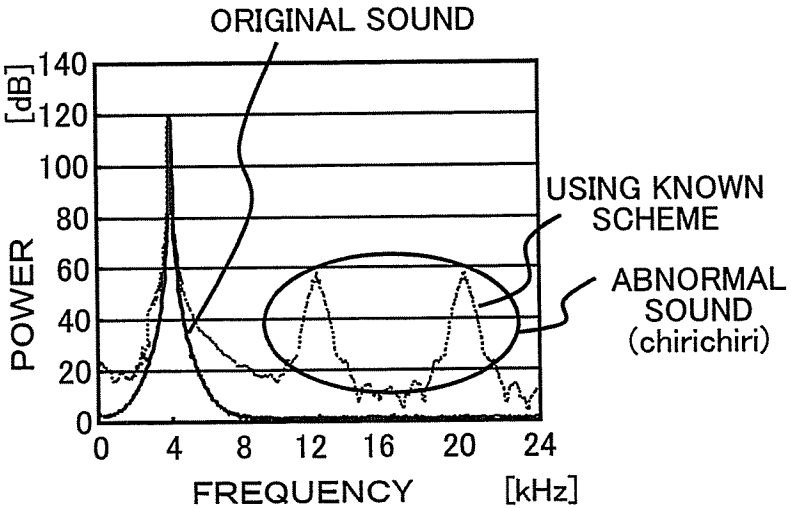
FIG. 14C illustrates frequency characteristics of an encoded signal.

Also, for example, in the known schemes, the amplitude fluctuates to overflow (e.g., to exceed (16 bits) which is the maximum value of PCM), resulting in the generation of clipping. Consequently, as shown in FIG. 14C, abnormal sound such as a sound of chi'ri'chi'ri (e.g. a clipping noise) is generated. Also, as shown in FIG. 14B, variations in the amplitude cause a sound to vibrate peceptually.

Figure 15:
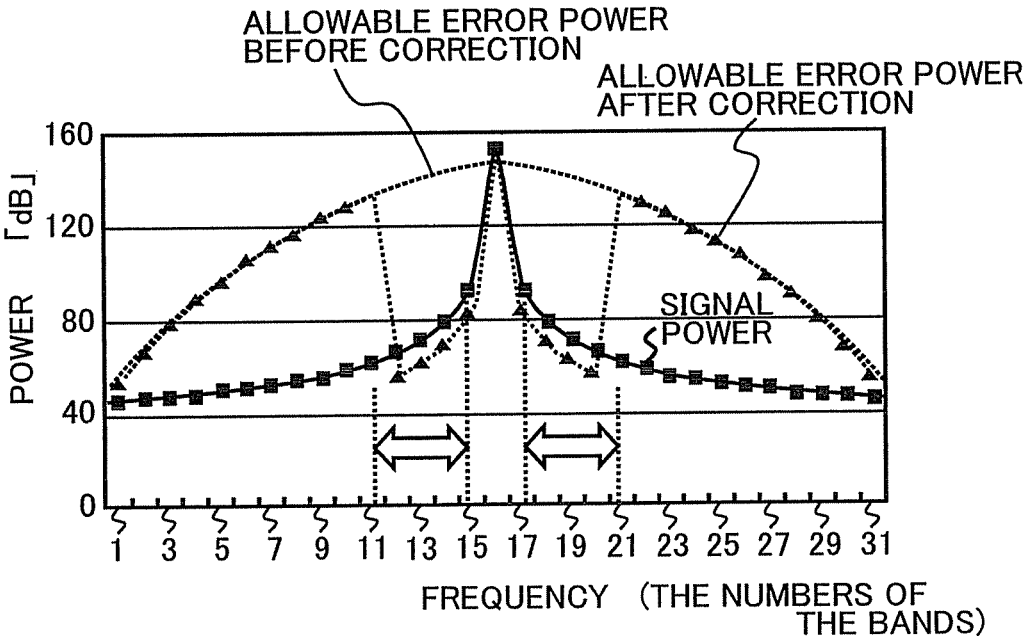
FIG. 15 illustrates frequency spectra adjacent to a tonal frequency spectrum.
Figure 16A:
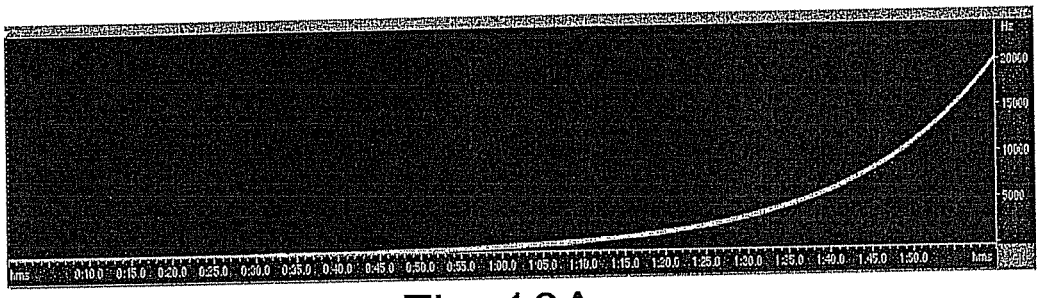
FIG. 16A illustrates an original sound.
Figure 16B:
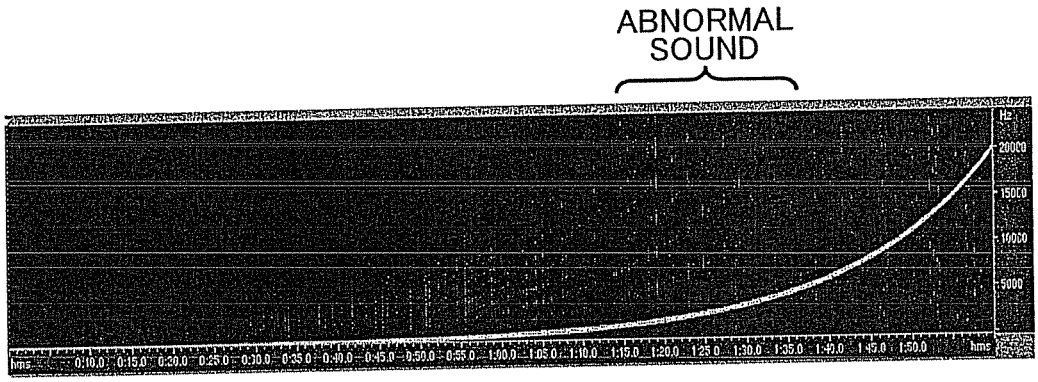
FIG. 16B illustrates a generation of abnormal sound generated during a quantization using the known scheme.
Figure 16C:
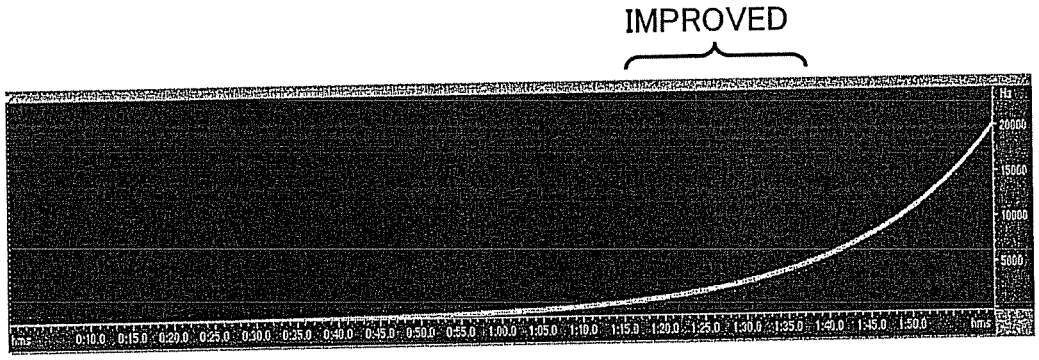
FIG. 16C illustrates a reduction of the abnormal sound.

Compared to such conventional schemes, according to the disclosed encoding device, frequency spectra adjacent to a tonal frequency spectrum can be reliably quantized as shown in FIG. 15. Thus, during encoding of an original sound shown in FIG. 16A, a sound to vibrate perceptually and the generation of abnormal sound of chi'ri'chi'ri generated during the quantization using the known schemes, as shown in FIG. 16B, are reduced as shown in FIG. 16C, and the encoded-sound quality of a tonal audio signal can be improved.

Also, according to the first embodiment, in the disclosed encoding device, with respect to the bands adjacent to the band containing the detected tonal frequency spectrum, the scale factor correcting unit 108 determines, as scale factors for the adjacent bands, such scale factors with respect to the adjacent bands that the quantization error powers determined from quantization errors that are errors generated during the quantization of frequency spectra contained in the adjacent bands become smaller than the allowable error powers determined by the allowable-error-power correcting unit 105 with respect to the adjacent bands, and the quantizing unit 109 quantizes each of the frequency spectra contained in the band whose scale factor was determined by the scale factor correcting unit 108, by using the scale factor determined by the scale factor correcting unit 108. Thus, even when the allowable error powers are corrected, it is possible to perform quantization using an appropriate scale factor.

Also, according to the first embodiment, in the disclosed encoding device, the tone detecting unit 103 detects the band containing the tonal frequency spectrum. Thereafter, the scale factor of the band is determined so that the a quantization value obtained from a largest one of the frequency spectra that constitute the band including the tonal frequency spectrum becomes a maximum Thus, it can be possible to minimize quantization errors. Specifically, since a quantization value obtained from a peak having a tonality takes a maximum value set based on the standard, it is possible to minimize quantization errors.

Also, according to the first embodiment, the disclosed encoding device stores a predetermined number of bands and determines adjacent bands which locate in the range of the stored predetermined number of bands around the band containing the detected tonal frequency spectrum as the center thereof. Thereafter, the encoding device corrects the allowable error powers of the adjacent bands. Thus, it can be possible to easily detect bands in which the allowable error powers are to be corrected.

[Second Embodiment]

The encoding device according to the first embodiment adopts a scheme in which the scale factor correcting unit 108 corrects the scale factor for the band detected by the tone detecting unit 103 so that the value by quantizing the largest one of frequency spectra in the band becomes the maximum value based on the standard. The present invention, however, is not limited to the scheme. For example, an encoding device according to a second embodiment may be such that it searches for a scale factor at which the quantization error power generated is small and uses the scale factor obtained by the searching.

The encoding device according to the second embodiment determines, as the scale factors, the scale factor determined by the scale factor determining unit 107 and a scale factor that is selected from changed scale factor obtained by changing the scale factor by a predetermined value. Then the encoding device uses one of both the scale factors which reduces the quantization error (or the quantization error power) generated during quantization. In the below, a description of the same points as those in the encoding device in the first embodiment is briefly given or is omitted.

In the encoding device according to the second embodiment, the scale factor correcting unit 108 corresponding to an "error determining unit" determines a quantization error power generated during the quantization of the frequency spectra contained in a band by using the scale factor determined by the scale factor determining unit 107 with respect to the band. Furthermore, the scale factor correcting unit 108 determines the quantization error power using the changed scale factor obtained by changing the scale factor determined by the scale factor determining unit 107.

Figure 17:
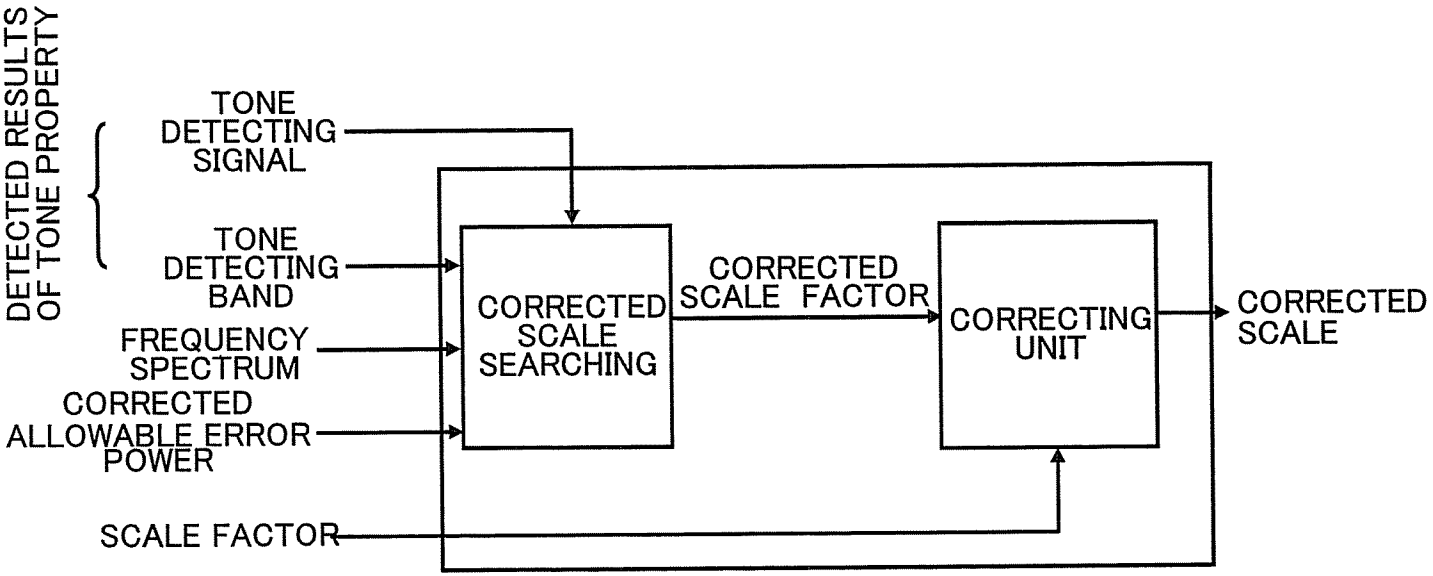
FIG. 17 illustrates a diagram showing an encoding device according to a second embodiment.

Thus, as shown in FIG. 17, the scale factor correcting unit 108 according to the second embodiment is different from one, shown in FIG. 11B, according to the first embodiment. That is, in scale-correction value searching, the scale factor correcting unit 108 according to the second embodiment uses allowable error powers (in the second embodiment, the allowable error power corrected by the allowable-error-power correcting unit 105 and the pre-correction allowable error power).

Specifically, in the encoding device according to the second embodiment, with respect to the band detected by the tone detecting unit 103, the scale factor correcting unit 108 quantizes each of the frequency spectra that constitute the band by using the scale factor determined by the scale factor determining unit 107. Then the encoding device determines a quantization error power generated during the quantization (refer to the consideration on underlying technology).

Specifically, hereinafter it is explained the case that the tone detecting unit 103 detects a band "b", the scale factor determining unit 107 determines a scale factor "Sb" for the band "b", and the number of frequency spectra that constitute the band "b" is "Nb".

First, in the encoding device according to the second embodiment, the scale factor correcting unit 108 quantizes each of the frequency spectra that constitute the band "b" to determine quantization values, by using the scale factor "Sb". Then, the unit 108 performs inverse-quantization to determine inversely quantized spectra by using the determined quantization values and the scale factor "Sb". For example, in the AAC encoding method, the scale factor correcting unit 108 determines a quantized value "quanti" obtained from the ith spectrum "speci" contained in the band "b" and an inversely quantized spectrum "ispeci" in accordance with expressions shown in FIGS. 18A and 18B.

Then, in the encoding device, the scale factor correcting unit 108 determines a quantization error power in the band from the pre-quantization frequency spectra and the inversely quantized spectra. For example, the scale factor correcting unit 108 determines a quantization error power "error_eb" in the band "b" in accordance with an expression shown in FIG. 18C. "Nb" in the expression shown in FIG. 18C indicates the number of frequency spectra contained in the band "b".

Also, specifically, the scale factor correcting unit 108 changes the scale factor determined by the scale factor determining unit 107 to a predetermined value. Then the unit 108 uses the changed scale factor (a change scale factor) to determine a quantization error power generated during the quantization with respect to the band detected by the tone detecting unit 103.

For example, the scale factor correcting unit 108 changes the scale factor "Sb" to a predetermined value "A" and uses the resulting change scale factor "S'b (e.g., "S'b" ="Sb"+ "A")" to determine a quantization error power generated during the quantization of the band "b".

Also, specifically, in the encoding device according to the second embodiment, the scale factor correcting unit 108 compares two quantization error powers, one is referred to as a "first" quantization error power and the other is referred to as a "second" quantization error power to determine whether the "second" quantization error power is smaller. The first quantization error power is generated by a use of the scale factor determined by the scale factor determining unit 107 and the second quantization error power is generated by a use of the change scale factor. In this case, when the "second" quantization error power is smaller than the "first" quantization error power, the scale factor correcting unit 108 corrects the scale factor (e.g., "Sb") for the band detected by the tone detecting unit 103 to the change scale factor (e.g., "S'b"). On the other hand, when the "second" quantization error power is not smaller than the "first" quantization error power, the scale factor correcting unit 108 does not correct the scale factor.

Also, the scale factor correcting unit 108 determines quantization error powers with respect to multiple scale factors by using various "As" and corrects the scale factor to a scale factor at which a smallest one of the quantization error powers is generated. It is shown as an example, in which the scale factor correcting unit 108 uses "Sb1" and "Sb2" as the change scale factors during first quantization and during second operations, respectively. When the unit 108 uses the change scale factor "Sb1" for the first operation to correct the scale factor "Sb" determined by the unit 107, the unit 108 then compares a quantization error power generated by a use of "Sb1" with a quantization error power generated by a use of "Sb2".

Also, for example, the scale factor correcting unit 108 determines whether or not the comparison is performed with respect to all predetermined change scale factors (e.g., scale factors (change scale factor candidates) determined from the predetermined "As"). Then, the scale factor correcting unit 108 continues the scale factor correction processing until the comparison is performed with respect to all change scale factors.

Although the description for the encoding device according to the second embodiment has been given of the scheme in which the scale factor correcting unit 108 compares the quantization error powers on a one-to-one basis, the present invention is not limited thereto. The arrangement may be such that quantization error powers are determined with respect to multiple scale factors, respectively, the comparison is simultaneously performed on the determined multiple (e.g., three or more) quantization error powers, and one scale factor at which the generated quantization error power is the smallest is used.

The value of "A" is arbitrary, and not only is a value that is greater than "0" used as "A", but also a value that is smaller than "0" may be used as "A". Also, the scale factor correcting unit 108 may pre-store a setting regarding the number of values used as the change scale factors (the number of times for determining and comparing the quantization error powers) and may execute the scale factor correction processing based on the setting.

The present invention is not limited to the scheme using various "As" (using multiple change scale factors). For example, the scale factors determined by the scale factor determining unit 107 may be compared with only one change scale factor. For example, one value that is estimated to reduce quantization errors may be pre-selected and used as the change scale factor. This makes it possible to quickly execute the scale factor correction processing.

One example of the flow of detailed processing performed by the scale factor correcting unit 108 in the encoding device according to the second embodiment is not described now and will be described below.

In the encoding device according to the second embodiment, the quantizing unit 109 quantizes each of the frequency spectra contained in the band, by using the scale factor (or the change scale factor). The scale factor (or the change scale factor) is one giving the smallest one of the quantization error powers determined by the scale factor correcting unit 108. For example, the scale factor correcting unit 108 determines quantization error powers with respect to the scale factor "Sb" determined by the scale factor determining unit 107 and the value "S'b" obtained by changing the scale factor to "A". Then, when the quantization error power generated by a use of "S'b" is the smallest, each of the frequency spectra that constitute the band detected by the tone detecting unit 103 is quantized using the scale factor "S'b".

[Processing Performed by Scale-Value Correcting Unit in Second Embodiment]

Figure 19:
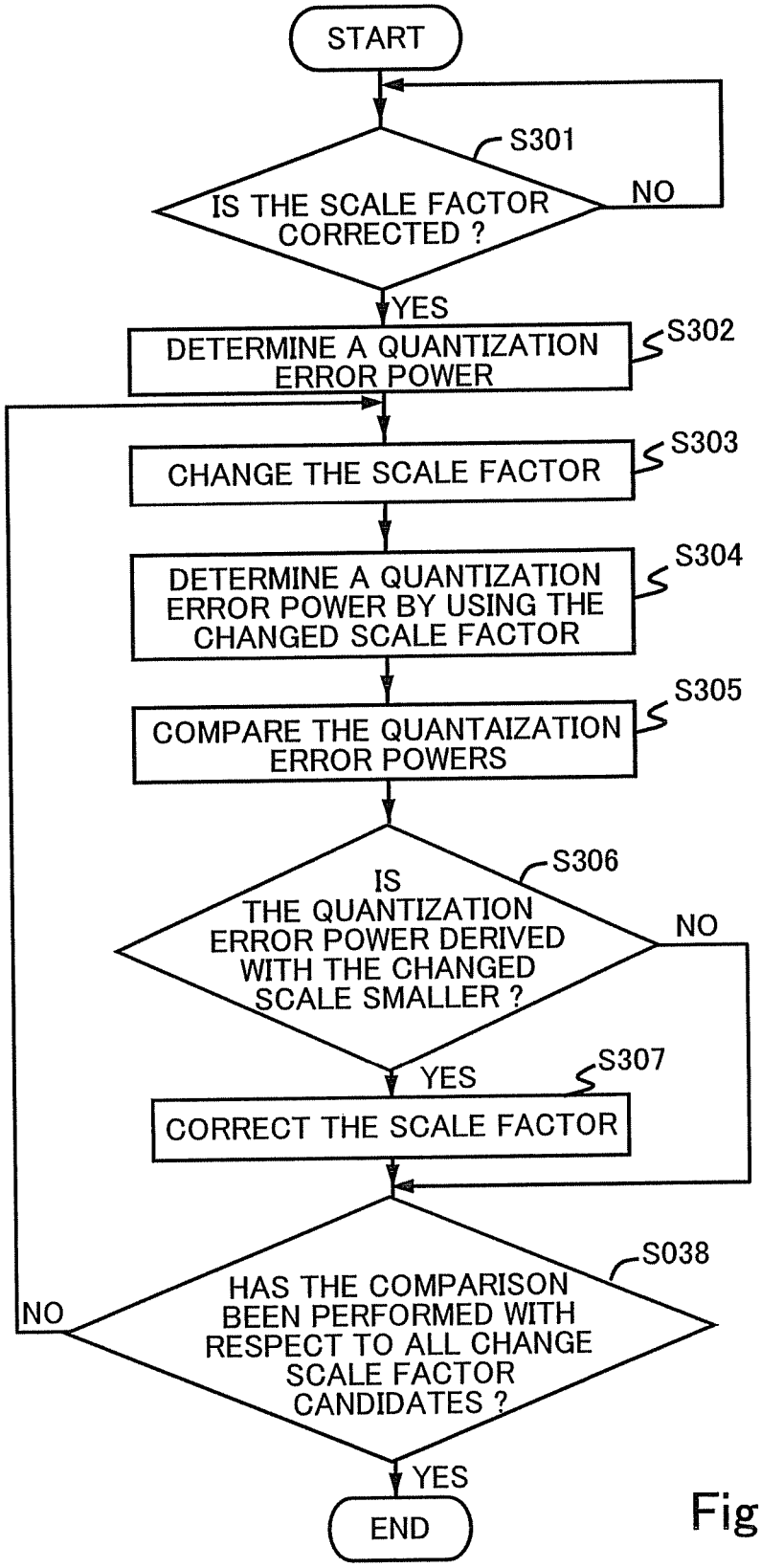
FIG. 19 illustrates a flowchart of a scale factor correction processing in an encoding device according to the second embodiment.

Processing performed by the scale factor correcting unit in the second embodiment will be described next using FIG. 19. FIG. 19 is a flowchart showing the flow of the scale factor correction processing performed by the encoding device according the second embodiment.

A description below is given using, as an example, a case in which the tone detecting unit 103 detects a band "b", the scale factor determining unit 107 determines a scale factor "Sb" for the band "b", and the number of frequency spectra that constitute the band "b" is "Nb", unless otherwise particularly stated.

As shown in FIG. 19, in the disclosed encoding device, when the scale factor correcting unit 108 is to correct the scale factor (YES in step S301), it determines a quantization error power (step S302). That is, the scale factor correcting unit 108 performs quantization by using the scale factor "Sb" determined by the scale factor determining unit 107 and determines a quantization error power generated during the quantization of the band "b".

Then, the scale factor correcting unit 108 changes the scale factor (step S303). That is, for example, the scale factor correcting unit 108 changes the scale factor "Sb" to a predetermined value "A". The scale factor correcting unit 108 then determines a quantization error power by using the changed scale factor (step S304). That is, for example, the scale factor correcting unit 108 determines a quantization error power generated during the quantization of the band "b", by using the obtained change scale factor "S'b".

Then, the scale factor correcting unit 108 compares the quantization error powers (step S305). That is, for example, with respect to the quantization error powers generated during the quantization of the band "b", the scale factor correcting unit 108 compares a "first" quantization error power" with a "second" quantization error power. The "first" quantization error power is generated when the scale factor "Sb" determined by the scale factor determining unit 107 is used. The "second" quantization error power is generated when the change scale factor "S'b" is used.

Then, the scale factor correcting unit 108 compares both of the quantization error powers derived by a use of the scale factor determined by the scale factor determining unit 107 and by a use of the change scale factor, to determine whether the quantization error power when the change scale factor is used is smaller (step S306). That is, for example, the scale factor correcting unit 108 determines whether the "second" quantization error power is smaller than the "first" quantization error power. In this case, when the "second" quantization error power is smaller than the "first" quantization error power (affirmative in step S306), the scale factor correcting unit 108 corrects the scale factor (step S307). That is, for example, the scale factor correcting unit 108 corrects the scale factor "Sb" to the change scale factor "S'b".

Then, when the scale factor correcting unit 108 corrects the scale factor (step S307) or when the "second" quantization error power is not smaller than the "first" quantization error power (negative in step S306), the scale factor correcting unit 108 determines whether the comparison has been performed with respect to all change scale factor candidates (step S308). In this case, when the comparison has been performed with respect to all change scale factor candidates (affirmative in step S308), the processing ends. On the other hand, when the comparison has not been performed with respect to all change scale factor candidates (negative in step S308), the processing from steps S303 to S307 described above is repeated until the comparison has been performed with respect to all change scale factor candidates.

As described above, according to the second embodiment, in the disclosed encoding device, the scale factor correcting unit 108 determines the quantization error powers by using the scale factor determined by the scale factor determining unit 107 and also using the change scale factor. Then, the encoding device performs quantization by using the scale factor (or the change scale factor) used when the smallest one of the determined quantization error powers was determined.

[Third Embodiment]

Although the first and second embodiments have been described above, the present invention may also implemented in various other forms other than the first and the second embodiments described above. Accordingly, other embodiments will be described below.

[Scale Factor]

The scheme in which the scale factor correcting unit 108 corrects the scale factor with respect to only the band detected by the tone detecting unit 103 has been described in the first and second embodiments described above. The present invention is not limited thereto and the scale factors may be corrected with respect to all bands. This allows an encoding device according to a third embodiment to reduce quantization errors with respect to other bands.

Also, for example, the quantizing unit 109 may quantize each of the frequency spectra contained in all bands by using the scale factor determined by the scale factor correcting unit 108. To put it with a specific example, the scale factor correcting unit 108 determines a scale factor with respect to only the band detected by the tone detecting unit 103 and corrects the scale factor. Further the unit 108 corrects the scale factors with respect to the other bands to the scale factor determined with respect to the band detected by the tone detecting unit 103. The quantizing unit 109 then quantizes each of the frequency spectra in all bands by using the scale factor determined by the tone detecting unit 103 with respect to the band detected by the tone detecting unit 103.

This allows the encoding device according to the third embodiment to reduce the number of bits used during the encoding of the scale factor. Specifically, during encoding, the scale factor is expressed by a difference from an adjacent scale factor. In this case, making all the scale factors the same scale factor makes it possible to reduce the number of bits required during the decoding of the scale factor set for the individual bands, compared to a scheme in which different scale factors are set for the respective bands.

[Adjacent Bands]

Although the scheme in which bands that exist in a predetermined band width, with the band detected by the tone detecting unit 103 being as the center thereof, are used as adjacent bands has been described in the first embodiment described above, the present invention is not limited thereto and bands that exist in a predetermined power width from a peak power may be used.

Figure 20:
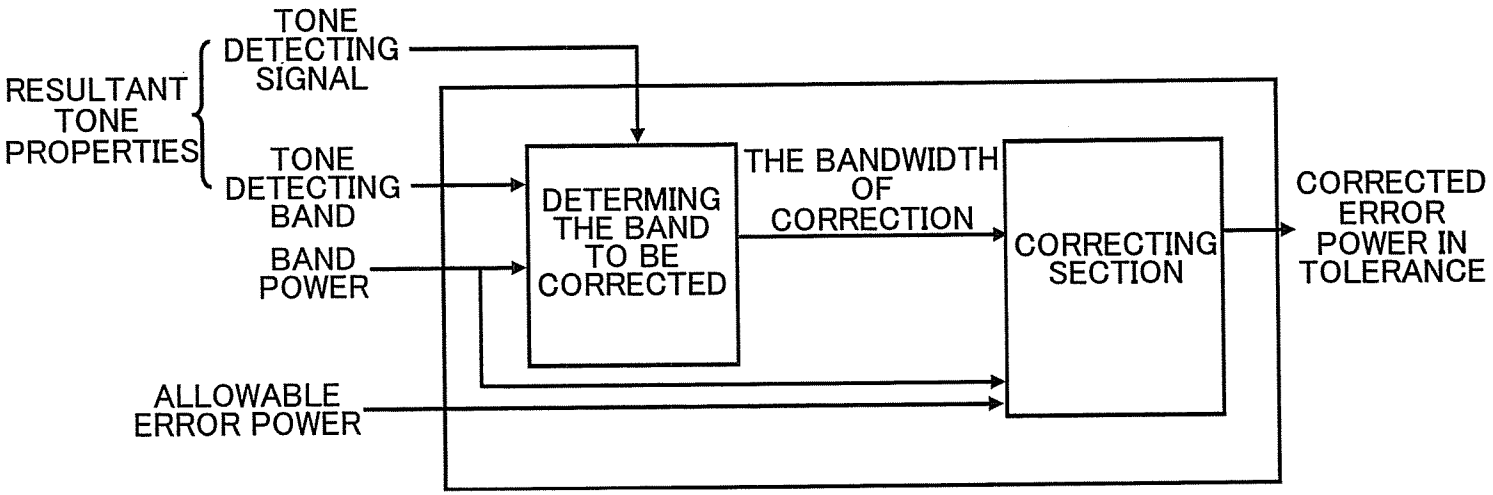
FIG. 20 illustrates a diagram showing an encoding device according to a third embodiment.

In other words, as shown in FIG. 20, first, based on the band power and the detection result from the tone detecting unit 103, a band width in which the allowable error powers are to be corrected is determined using a preset power width, and then, the allowable error powers are corrected.

Specifically, in the encoding device according to the third embodiment, the allowable-error-power correcting unit 105 has a power-width storing unit. A predetermined power width is stored in the power-width storing unit. The allowable-error-power correcting unit 105 stores, for example, "G" in the power-width storing unit.

Then, in the encoding device, the tone detecting unit 103 detects the band containing the tonal frequency spectrum. Further, the allowable-error-power correcting unit 105 regards as an adjacent band or adjacent bands that have a power value or power values and include the band containing the tonal frequency spectrum. The power value or power values are greater than or equal to a power value attenuated from the power value of the band detected by the tone detecting unit 103 to the predetermined power width stored in the power-width storing unit. The allowable-error-power correcting unit 105 corrects the allowable error power(s) for the adjacent band or adjacent bands as shown in FIG. 21.

Figure 21:
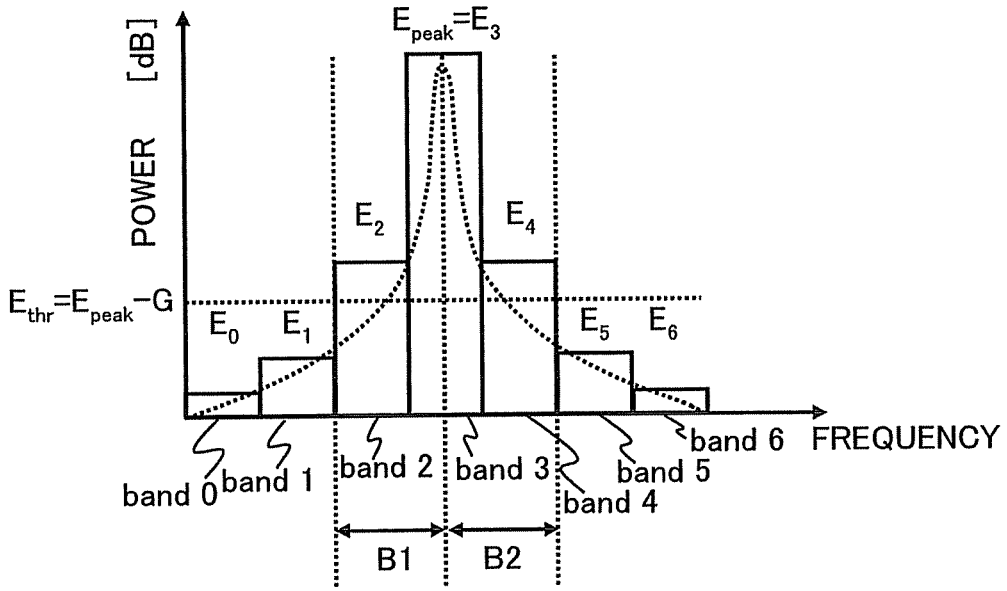
FIG. 21 illustrates a diagram showing an encoding device according to the third embodiment.

For example, a description is specifically given using the example shown in FIG. 21. In this case, the description is given assuming that the power of frequency spectra in a tonal band is "Epeak", the power-width storing unit stores "G", and seven bands exists. In the encoding device according to the third embodiment, the allowable-error-power correcting unit 105 determines "Ethr" that is a power obtained by attenuating "G" from "Epeak" and uses "Ethr" as a power threshold for determining bands in which the allowable error powers are to be corrected.

For example, in the encoding device according to the third embodiment, the allowable-error-power correcting unit 105 checks for bands having greater powers than the power threshold in bands adjacent to the tone band. For example, in the example shown in FIG. 21, since bands "2" and "4" exhibit greater powers than the power threshold, the allowable-error-power correcting unit 105 determines that the band width in which the allowable error powers are to be corrected is "B1 (the number of bands at the lower frequency side than the band adjacent to the tone band)=1" and "B2 (the number of bands at the higher frequency side than the band adjacent to the tone band)=1".

In this manner, the encoding device according to the third embodiment can easily detect bands in which the allowable error powers are to be corrected.

[System Configuration]

Of the processing described in the present embodiment, the entire or part of the processing described as being automatically performed can be manually performed or the entire or part of the processing described as being manually performed can be automatically performed by a known method. In addition, the processing processes, the control processes, the specific names, and information including various types of data and parameters which are illustrated in the document and the drawings (e.g., FIGS. 5 to 13 and FIGS. 17 to 21) can be arbitrary modified, unless otherwise particularly stated.

[Combination of Embodiments]

Also, the description in the first embodiment described above has been given of, for example, a case in which (1) the scheme for correcting the scale factor, (2) the scheme using the scale factor at which the quantization value becomes the maximum value, and (3) the scheme using the predetermined bandwidth during the detection of adjacent bands are implemented together during the correction of the allowable error powers. However, the present invention is not limited to the case, and during the correction of the allowable error powers, (1) to (3) do not have to be implemented together and only one or some of (1) to (3) may also be implemented.

Also, similarly, with respect to the schemes described in the second embodiment and the third embodiment described above, the present invention is not limited to a case in which one of the schemes is implemented, and multiple schemes maybe implemented together.

[Program]

Figure 22:
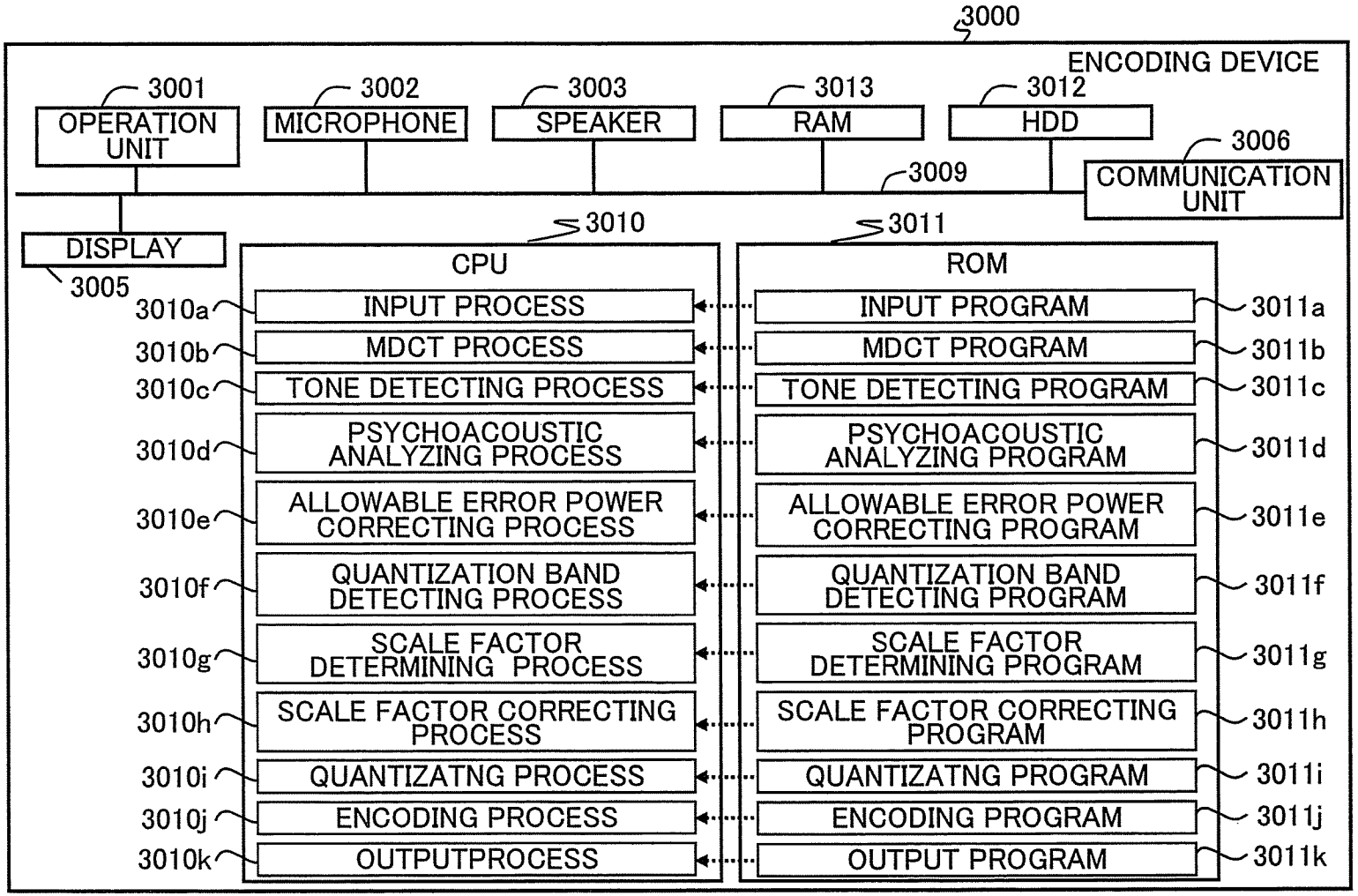
FIG. 22 illustrates a diagram of a program for the encoding device according to the first embodiment.

Meanwhile, although a case in which various types of processing are achieved by hardware logic has been described in the first embodiment described above, the present invention is not limited thereto and the processing may be achieved by causing a computer to execute a prepared program. Accordingly, one example of a computer for executing an encoding program having the same function as the encoding device illustrated in the first embodiment described above will be described below using FIG. 22. FIG. 22 is a diagram for describing a program for the encoding device according to the first embodiment.

As shown in the figure, an encoding device 3000 in the first embodiment has a configuration in which an operation unit 3001, a microphone 3002, a speaker 3003, a display 3005, a communication unit 3006, a CPU 3010, a ROM 3011, a HDD 3012, and a RAM 3013 are connected through a bus 3009 and so on.

The ROM 3011 pre-stores control programs such as an input program 3011*a*, an MDCT program 3011*b*, a tone detecting program 3011*c*, a psychoacoustic analyzing program 3011*d*, an allowable-error-power correcting program 3011*e*, a quantization-band detecting program 3011*f*, a scale factor determining program 3011*g*, a scale factor correcting program 3011*h*, a quantizing program 3011*i*, an encoding program 3011*j*, and an output program 3011*k*. Each of the pre-stored control programs provides the same functions as the input unit 101, the MDCT unit 102, the tone detecting unit 103, the psychoacoustic analyzing unit 104, the allowable-error-power correcting unit 105, the quantization-band detecting unit 106, the scale factor determining unit 107, the scale factor correcting unit 108, the quantizing unit 109, the encoding unit 110, and the output unit 111 which are illustrated in the first embodiment described above. These programs 3011*a* to 3011*k* may be integrated together or distributed, as required, similarly to the elements that constitute the encoding device shown in FIG. 6.

The CPU 3010 reads these programs 3011*a* to 3011*k* from the ROM 3011 and executes them to thereby cause the programs 3011*a* to 3011*k* to function as an input process 3010*a*, an MDCT process 3010*b*, a tone detecting process 3010*c*, a psychoacoustic analyzing process 3010*d*, an allowable-error-power correcting process 3010*e*, a quantization-band detecting process 3010*f*, a scale factor determining process 3010*g*, a scale factor correcting process 3010*h*, a quantizing process 3010*i*, an encoding process 3010*j*, and an output process 3010*k*, as shown in FIG. 22. The processes 3010*a* to 3010*k* correspond to the input unit 101, the MDCT unit 102, the tone detecting unit 103, the psychoacoustic analyzing unit 104, the allowable-error-power correcting unit 105, the quantization-band detecting unit 106, the scale factor determining unit 107, the scale factor correcting unit 108, the quantizing unit 109, the encoding unit 110, and the output unit 111 which are shown in FIG. 6, respectively.

[Others]

The encoding device described in the present embodiment can be achieved by causing a computer, such as a personal computer or workstation, to execute the prepared program. This program can be distributed over a network, such as the Internet. This program can also be recorded to a computer-readable storage media, such as a hard disk, flexible disk (FD), CD-ROM, MO, and DVD, and can also be executed by causing the computer to read the program from the recording medium.

The following appendices are further disclosed with respect to illustrative embodiments including the embodiments described above.

What is claimed is:

1. An encoding device for converting an audio signal into a plurality of frequency spectra and for quantizing and encoding each of the frequency spectra comprising:

a processor; and a memory which stores a plurality of instructions, which when executed by the processor, cause the processor to execute, correcting for a plurality of allowable error powers determined in accordance with the audio signal, when a tonal frequency spectrum is detected from the frequency spectra, each of the allowable error powers corresponding to a quantization error of each of the frequency spectra;

quantizing each of the frequency spectra having greater powers than the allowable error powers corrected by the correcting;

determining a plurality of the allowable error powers with respect to respective bands obtained by dividing a frequency of the audio signal by a predetermined width; and detecting the tonal frequency spectrum and also the band containing the tonal frequency spectrum, the correcting performing correction such that the plurality of the allowable error powers determined by the determining with respect to bands adjacent to the band detected by the detecting become smaller than powers of the frequency spectra with respect to the adjacent bands.

2. An encoding device for encoding an audio signal comprising:

a processor; and a memory which stores a plurality of instructions, which when executed by the processor, cause the processor to execute, converting the audio signal into frequency spectra;

determining a plurality of allowable error powers in accordance with the audio signal, each of the allowable error powers being indicative of quantizing each of the frequency spectra;

detecting a tonal frequency spectrum from the frequency spectra converted by the converting;

correcting the allowable error powers by using a result of the detection performed by the detecting and the allowable error powers determined by the determining; and quantizing each of the frequency spectra having greater powers than the allowable error powers corrected by the correcting, wherein:

the determining determines the plurality of the allowable error powers with respect to respective bands obtained by dividing a frequency of the audio signal by a predetermined width;

the detecting detects the tonal frequency spectrum and also the band containing the tonal frequency spectrum, the correcting performs correction such that the plurality of the allowable error powers determined by the determining with respect to bands adjacent to the band detected by the detecting become smaller than powers of the frequency spectra with respect to the adjacent bands.

3. The encoding device according to claim 2, wherein the quantizing reduces dynamic ranges of the frequency spectra to dynamic ranges uniquely specified by scale factors and quantizes each of the frequency spectra in the reduced dynamic ranges, wherein the plurality of instructions cause the processor to execute determining, in a first way, for the respective bands, such scale factors that the quantization error powers determined from quantization errors that are errors generated during quantization of the frequency spectra contained in the bands become smaller than the allowable error powers determined by the determining with respect to the bands, and determining, in a second way with respect to bands adjacent to the band containing the tonal frequency spectrum detected by the detecting, such scale factors with respect to the adjacent bands that the quantization error powers determined from the quantization errors that are the errors generated during the quantization of the frequency spectra contained in the adjacent bands become smaller than the allowable error powers determined by the correcting with respect to the adjacent bands; and wherein the quantizing quantizes each of the frequency spectra contained in the bands whose scale factors were determined by the determining in a second way, and quantizes each of the frequency spectra contained in the bands whose scale factors were not determined by the determining in a second way, by using the scale factors determined by the determining in a first way.

4. The encoding device according to claim 2, wherein the quantizing obtains values by quantizing the frequency spectra, a maximum value obtainable as the values is set;

wherein the plurality of instructions cause the computer to execute:

determining, in a first way, for the respective bands, such scale factors that the quantization error powers determined from quantization errors that are errors generated during quantization of the frequency spectra contained in the bands become smaller than the allowable error powers determined by the determining with respect to the bands, and determining, in a second way, as the scale factor with respect to the band containing the tonal frequency spectrum detected by the detecting, such a scale factor that a value obtained from a largest one of the frequency spectra that constitute the band becomes the largest value; and wherein the quantizing quantizes each of the frequency spectra contained in the band whose scale factor was determined by the determining in a second way, and quantizes each of the frequency spectra contained in the bands whose scale factors were not determined, by using the scale factors determined by the determining in a first way.

5. The encoding device according to claim 2, further comprising:

determining, in a first way for the respective bands, such scale factors that the quantization error powers determined from quantization errors that are errors generated during quantization of the frequency spectra contained in the bands become smaller than the allowable error powers determined by the determining respect to the bands; and determining in a second way, the quantization error powers generated during quantization of the frequency spectra contained in the bands, by using the scale factors determined by the determining in a first way with respect to the bands and by using change scale factors that are scale factors obtained by changing the scale factors, determined by the determining, in a first way, to predetermined values; and wherein the quantizing quantizes each of the frequency spectra contained in the bands by using the scale factor or the change scale factor at which a smallest one of the quantization error powers determined by the determining in a second way, was determined.

6. The encoding device according to 4, wherein the quantizing quantizes each of the frequency spectra contained in all the bands by using the scale factor determined by the determining in a second way.

7. The encoding device according to 2, further comprising a storing a predetermined number of bands, wherein the correcting regards, as adjacent bands, bands located in the range of the predetermined number of bands stored by the storing, with the band containing the tonal frequency spectrum detected by the detecting being as the center thereof, and corrects the allowable error powers.

8. The encoding device according to 2, further comprising storing a predetermined power width, wherein the correcting regards, as the adjacent band(s), one or multiple continuous bands that include the band containing the tonal frequency spectrum detected by the detecting and that have a power value or power values greater than or equal to a power value attenuated from the power value of the band detected by the detecting to the predetermined power width stored in the storing, and corrects the allowable error power(s).

9. An encoding method for converting an audio signal into frequency spectra and encoding the frequency spectra, comprising:

detecting, using a computer, a tonal frequency spectrum from the frequency spectra and correcting allowable error powers in accordance with the audio signal;

quantizing the frequency spectra by using the corrected allowed error powers; and determining a plurality of the allowable error powers with respect to respective bands obtained by dividing a frequency of the audio signal by a predetermined width; wherein the detecting detects the tonal frequency spectrum and also the band containing the tonal frequency spectrum, the correcting performs correction such that the plurality of the allowable error powers determined by the determining with respect to bands adjacent to the band detected by the detecting become smaller than powers of the frequency spectra with respect to the adjacent bands.

10. A non-transitory computer-readable storage medium storing a computer program to cause a computer to perform processing for converting an audio signal into frequency spectra and encoding the frequency spectra, comprising:

detecting a tonal frequency spectrum from the frequency spectra and correcting allowable error powers in accordance with the audio signal;

quantizing the frequency spectra by using the corrected allowed error powers; and determining a plurality of the allowable error powers with respect to respective bands obtained by dividing a frequency of the audio signal by a predetermined width, wherein the detecting detects the tonal frequency spectrum and also the band containing the tonal frequency spectrum, the correcting performs correction such that the plurality of the allowable error powers determined by the determining with respect to bands adjacent to the band detected by the detecting become smaller than powers of the frequency spectra with respect to the adjacent bands.

* * * * *

UNITED STATES PATENT AND TRADEMARK OFFICE

CERTIFICATE OF CORRECTION

PATENT NO. : 9,076,440 B2
APPLICATION NO. : 12/367963
DATED : July 7, 2015
INVENTOR(S) : Miyuki Shirakawa et al.

It is certified that error appears in the above-identified patent and that said Letters Patent is hereby corrected as shown below:

ON THE TITLE PAGE

ITEM (57) Abstract, Line 4

Delete "with," and insert --width,--, therefor.

IN THE CLAIMS

Claim 5, Column 24, Line 53

After "determining" insert --with--.

Claim 6, Column 25, Line 1

After "to" insert --claim--.

Claim 7, Column 25, Line 5

After "to" insert --claim--.

Claim 8, Column 25, Line 14

After "to" insert --claim--.

Signed and Sealed this
Thirteenth Day of October, 2015

Michelle K. Lee

Michelle K. Lee
*Director of the United States Patent and Trademark Office*